US010010153B2

(12) United States Patent
Kim et al.

(10) Patent No.: US 10,010,153 B2
(45) Date of Patent: Jul. 3, 2018

(54) COSMETIC CONTAINER

(71) Applicant: LG HOUSEHOLD & HEALTH CARE LTD., Seoul (KR)

(72) Inventors: Sung Tae Kim, Seoul (KR); Gu Yong Lee, Seoul (KR); Hyeon Jeong Kim, Cheongju-si (KR); Sung Soo Kang, Daejeon (KR)

(73) Assignee: LG HOUSEHOLD & HEALTH CARE LTD., Seoul (KR)

( * ) Notice: Subject to any disclaimer, the term of this patent is extended or adjusted under 35 U.S.C. 154(b) by 0 days.

(21) Appl. No.: 14/775,437

(22) PCT Filed: Aug. 21, 2014

(86) PCT No.: PCT/KR2014/007796

§ 371 (c)(1),
(2) Date: Sep. 11, 2015

(87) PCT Pub. No.: WO2015/122584

PCT Pub. Date: Aug. 20, 2015

(65) Prior Publication Data

US 2016/0015149 A1 Jan. 21, 2016

(30) Foreign Application Priority Data

Feb. 14, 2014 (KR) ..... 10-2014-0017013
Jun. 5, 2014 (KR) ..... 10-2014-0068332

(51) Int. Cl.
*A45D 33/02* (2006.01)
*A45D 40/00* (2006.01)
(Continued)

(52) U.S. Cl.
CPC ..... *A45D 40/0075* (2013.01); *A45D 33/006* (2013.01); *A45D 33/008* (2013.01);
(Continued)

(58) Field of Classification Search
CPC .... A45D 33/34; A45D 33/006; A45D 33/025; A45D 33/06; A45D 33/003; A45D 33/00;
(Continued)

(56) References Cited

U.S. PATENT DOCUMENTS 4,982,751 A * 1/1991 Oishi ..... A45D 33/02 132/299
5,548,085 A * 8/1996 Flores ..... H02B 1/28 174/366

(Continued)

FOREIGN PATENT DOCUMENTS

CN 2618486 Y 8/2004
CN 200959917 Y 10/2007

(Continued)

OTHER PUBLICATIONS

Author Unknown, "Disassembly photo of the Applicant's product," Date unknown, 6 pages, with a partial English translation.

(Continued)

*Primary Examiner* — Rachel Steitz
(74) *Attorney, Agent, or Firm* — Birch, Stewart, Kolasch & Birch, LLP

(57) ABSTRACT

The present invention relates to a cosmetic vessel including a discharge unit discharging cosmetics to an outside, and a discharge plate provided at one side of the discharge unit from which the cosmetics are discharged, including at least one discharge hole, and formed of a metal of SUS 300 series.

6 Claims, 12 Drawing Sheets

(51) Int. Cl.

| | |
|---|---|
| ***A45D 34/00*** | (2006.01) |
| ***A45D 33/00*** | (2006.01) |
| ***A45D 40/22*** | (2006.01) |
| ***B05B 11/00*** | (2006.01) |
| ***A45D 33/06*** | (2006.01) |

(52) U.S. Cl.
CPC ..... *A45D 33/06* (2013.01); *A45D 34/00* (2013.01); *A45D 40/22* (2013.01); *B05B 11/3001* (2013.01); *A45D 2200/055* (2013.01); *A45D 2200/056* (2013.01); *A45D 2200/1018* (2013.01); *A45D 2200/155* (2013.01)

(58) Field of Classification Search
CPC .... A45D 33/02; A45D 40/0075; A45D 40/22; A45D 34/00; A45D 2200/005; A45D 2200/056; A45D 2200/1018; A45D 2200/155; B05B 11/3001
See application file for complete search history.

(56) References Cited

U.S. PATENT DOCUMENTS

| | | | | |
|---|---|---|---|---|
| 8,021,064 | B2 * | 9/2011 | Gueret | A45D 34/04 401/44 |
| 2003/0213723 | A1 * | 11/2003 | Lombardi | A45D 33/003 206/581 |
| 2005/0109363 | A1 * | 5/2005 | Matsuoka | A45D 33/02 132/298 |
| 2008/0264440 | A1 * | 10/2008 | Thorpe | A45D 33/02 132/299 |
| 2008/0279616 | A1 | 11/2008 | Thorpe | |
| 2009/0188517 | A1 | 7/2009 | Thorpe et al. | |
| 2011/0278328 | A1 | 11/2011 | Kang | |
| 2012/0125361 | A1 * | 5/2012 | Yeom | A45D 33/26 132/293 |
| 2012/0305606 | A1 | 12/2012 | Lee et al. | |
| 2014/0069840 | A1 | 3/2014 | Park | |
| 2015/0079862 | A1 | 3/2015 | Jeong et al. | |
| 2016/0073761 | A1 * | 3/2016 | Lee | A45D 33/006 132/298 |
| 2016/0073762 | A1 | 3/2016 | Lee | |

FOREIGN PATENT DOCUMENTS

| | | | | |
|---|---|---|---|---|
| CN | 101301140 | A | 11/2008 | |
| CN | 201192162 | Y | 2/2009 | |
| CN | 101779858 | A | 7/2010 | |
| CN | 201847054 | U | 6/2011 | |
| JP | 59-25704 | A | 2/1984 | |
| JP | 59-184709 | U | 12/1984 | |
| JP | 62-127216 | U | 8/1987 | |
| JP | 64-43819 | U | 3/1989 | |
| JP | 1-91423 | U | 6/1989 | |
| JP | 1-164924 | U | 11/1989 | |
| JP | 4-91888 | U | 8/1992 | |
| JP | 5-23135 | Y2 | 6/1993 | |
| JP | 6-1082 | Y2 | 1/1994 | |
| JP | 6-2605 | Y2 | 1/1994 | |
| JP | 8-158940 | A | 6/1996 | |
| JP | 8-336418 | A | 12/1996 | |
| JP | 3061178 | U | 9/1999 | |
| JP | 2000-129448 | A | 5/2000 | |
| JP | 2001-292827 | A | 10/2001 | |
| JP | 2002-10827 | A | 1/2002 | |
| JP | 2003-275660 | A | 9/2003 | |
| JP | 3452688 | B2 | 9/2003 | |
| JP | 2004-208975 | A | 7/2004 | |
| JP | 3853952 | B2 | 12/2006 | |
| JP | 4129175 | B2 | 8/2008 | |
| JP | 2009-11801 | A | 1/2009 | |
| JP | 4338383 | B2 | 10/2009 | |
| JP | 4590593 | B2 | 12/2010 | |
| JP | 4738025 | B2 | 8/2011 | |
| JP | 2012-206774 | A | 10/2012 | |
| JP | 2013-116192 | A | 6/2013 | |
| KR | 20-0370308 | Y1 | 12/2004 | |
| KR | 20-0372911 | Y1 | 1/2005 | |
| KR | 20-0402608 | Y1 | 12/2005 | |
| KR | 20-0416530 | Y1 | 5/2006 | |
| KR | 10-0591522 | | 6/2006 | |
| KR | 10-0751835 | B1 | 8/2007 | |
| KR | 10-0776286 | B1 | 11/2007 | |
| KR | 10-0781747 | B1 | 12/2007 | |
| KR | 20-0450515 | Y1 | 10/2010 | |
| KR | 20-0453355 | Y1 | 4/2011 | |
| KR | 10-2011-0063318 | A | 6/2011 | |
| KR | 20-2011-0008182 | U | 8/2011 | |
| KR | 10-1103188 | B1 | 1/2012 | |
| KR | 20-0459637 | Y1 | 3/2012 | |
| KR | 10-1157218 | B1 | 7/2012 | |
| KR | 10-1159135 | B1 | 7/2012 | |
| KR | 10-1171305 | B1 | 8/2012 | |
| KR | 20-0461897 | Y1 | 8/2012 | |
| KR | 10-2013-0116194 | A | 10/2013 | |
| KR | 20-2013-0006083 | U | 10/2013 | |
| KR | 10-1355364 | B1 | 1/2014 | |
| KR | 20-0470757 | Y1 | 1/2014 | |
| KR | 10-1429089 | B1 | 8/2014 | |
| KR | 10-2014-0121797 | A | 10/2014 | |
| KR | 20-2014-0005481 | U | 10/2014 | |
| KR | 20-2014-0005553 | U | 10/2014 | |
| KR | 10-2014-0146982 | A | 12/2014 | |
| KR | 20-0475944 | Y1 | 1/2015 | |
| KR | 10-1494168 | B1 | 2/2015 | |
| KR | 20-0476239 | Y1 | 2/2015 | |
| WO | WO 2005082200 | A1 * | 9/2005 | A45D 33/02 |
| WO | WO 2008/007832 | A1 | 1/2008 | |
| WO | WO 2014/014198 | A1 | 1/2014 | |
| WO | WO 2015/056902 | A1 | 4/2015 | |
| WO | WO 2015072732 | A1 * | 5/2015 | B05B 11/3001 |
| WO | WO 2015088100 | A1 * | 6/2015 | A45D 34/00 |

OTHER PUBLICATIONS

Author Unknown, "IOPE Retigen Smoothing Powder," Website, Mar. 21, 2012, pp. 1-7 (8 pages total), URL: http://www.ezday.co.kr/bbs/view_board.html?q_sq_board=3500546, with a partial English translation.

Author Unknown, "New product Cushion Foundation Jumped . . . VDL Metal Cushion Foundation Launch," Screenshot of an article about an Applicant's product launch, Mar. 14, 2014, pp. 1-2 (3 pages total), with a partial English translation.

Author Unknown, "Product Details," A screenshot of an online shopping website selling a shower head using SUS, Oct. 2009, pp. 1-6 (7 pages total), URL: http://www.bb.co.kr/model/2259117, with a partial English translation.

Author Unknown, "Types and characteristics of stainless steels," Engineering Box, Tech blog—Mechanical engineering, Design, CAD/CAM, IT, Feb. 17, 2014, pp. 1-5 (6 pages total), URL: http://starletzzang.blogspot.kr/2014/02/stainless.html, with a partial English translation.

Author Unknown, "VDL Event," Screenshot of a blog post on an Applicant's product, Mar. 31, 2014, pp. 1-12 (13 pages total), URL: http://blog.naver.com/PostView.nhn?blogId=greenti7 &logNo=150187917042&redirect=Dlog&widgetTy, with a partial English translation.

English Summary of Result of Invalidation Trial for Korean Patent No. 10-1566114-61, 2016, 1 page.

Invalidation Trial Request for Korean Patent No. 10-1471339-B1, dated Sep. 18, 2015, pp. 1-37 (42 pages total).

Invalidation Trial Request for Korean Patent No. 10-1566114-B1, dated Jan. 22, 2016, pp. 1-35 (37 pages total).

Result of Invalidation Trial for Korean Patent No. 10-1471339-B1, decided Oct. 6, 2016, pp. 1-28 (29 pages total), with a partial English translation.

"Mule ice foundcealer," BEAUTY+, Jul. 17, 2013, pp. 1-20 (21 pages total), with an English summary.

(56) References Cited

OTHER PUBLICATIONS

"Mule ice foundcealer," Ce'Ci, Jul. 25, 2013, pp. 1-7 (8 pages total), with an English summary.
Preparatory Pleadings of Appeal against Invalidation Trial with regard to KR-10-1471339-B1, dated Dec. 20, 2016, together with a partial English translation thereof.

* cited by examiner

BEFORE USE AFTER USE

METAL (BEFORE USE)

PLASTIC (BEFORE USE)

METAL (AFTER USE 20 TIMES)

PLASTIC (AFTER USE 20 TIMES)

COSMETIC CONTAINER

TECHNICAL FIELD

The present invention relates to a cosmetic vessel, and more particularly, to a cosmetic vessel capable of improving user satisfaction by providing a cooling effect to cosmetics being discharged.

BACKGROUND ART

Solid cosmetics such as foundations or liquid cosmetics such as sunscreens which are in widespread use help protect and lighten a user's skin and reduce wrinkles. The user may apply cosmetics onto a makeup puff and pat to spread the cosmetics on a user's face.

Cosmetics may be sold with a makeup puff received in a cosmetic vessel. Generally, the puff may be received in a lid of the cosmetic vessel. Therefore, to apply cosmetics, a user may open the lid to take the puff out of it, and press the puff onto the cosmetics with the user's fingers inserted under an elastic ribbon of the puff to pick up a predetermined amount of the cosmetics.

However, when the user directly presses the puff onto the cosmetics, cosmetics more than the user needs may be applied to the puff by the pressure the user applies on the puff, which may cause waste of the puff. Therefore, recently, a method has been developed in which a sponge is impregnated with liquid cosmetics and the liquid cosmetics permeated into the sponge is discharged and supplied to the puff when the user presses the sponge with the puff.

However, in the above-described conventional cosmetics vessel, cosmetics more than the user needs may be discharged to the puff by the pressure the user presses the sponge. In addition, when the user presses the sponge too hard by mistake, the cosmetics may be discharged to a portion of the puff adjacent to the user's fingers as well as the surface of the puff which directly touches the user's skin, which may cause considerable inconvenience to the user.

In addition, conventionally, when the user applies the cosmetics to the user's skin such as a face by tapping the puff holding the cosmetics from the cosmetics-impregnated sponge, the user repeats pressing the puff against the cosmetics-impregnated sponge to apply the cosmetics. In this manner, however, the cosmetics may be seriously contaminated with viruses, molds, or bacteria on the skin. Furthermore, the contaminated microorganism in the cosmetics may keep growing until the user uses up the cosmetics. As a result, such contamination causes skin stimulation, skin problems, skin allergies, smell change, and the like. If the user experiences such inconvenience, the user will avoid using the cosmetics. Although the user wishes to use the cosmetic product for beauty, the cosmetics may rather cause personal hygiene problems and skin problems. Therefore, the user may feel strongly dissatisfied with the cosmetics.

For safe storage and use of cosmetics to avoid contamination by microorganism, a vessel container may have a structure to prevent cosmetic contents from contacting external contaminants. In addition, while only a desired amount of cosmetics is used, the remaining cosmetics are to be safely kept without contamination by microorganism.

The solution and review for such structure are to be earnestly sought. Thus, recommendation for use of cosmetics for beauty without finding a fundamental solution to it may rather cause serious skin side effects.

In addition, in general, the user keeps a cosmetic vessel in a storage compartment of a vehicle or a purse when going outside, and takes out the cosmetic vessel when using it. In such case, since heat from the place where the cosmetic vessel is stored permeates into the cosmetic vessel, the temperature of the cosmetic contents may increase, and the heat may remain in the cosmetics as latent heat. However, when the cosmetics with the increased temperature are applied the user's skin, the feeling when the cosmetics are applied to the skin may deteriorate.

In other words, conventionally, when applying the cosmetics, the user may find the temperature of the cosmetics unpleasantly warm and may not feel refreshed due to the heat of the cosmetics. At the same time, since the cosmetics do not smoothly permeate into the skin, the user may not feel that the user's makeup looks natural.

PRIOR ART DOCUMENT (Cited reference 1) Korea Registration Publication No. 10-1355364 (published on Jan. 23, 2014)

DISCLOSURE

Technical Problem

The present invention is conceived to solve the aforementioned problems, and an object of the present invention is to provide a container vessel discharging liquid cosmetics by a pump and including a mesh member having a mesh shape formed above the pump to prevent the cosmetics being discharged from splashing upwards, so that user convenience may be improved.

Another object of the present invention is to provide a cosmetic vessel including a guide plate having discharge paths in a radial direction above the pump and a metallic discharge plate having a plurality of discharge holes above the guide plate, so that cosmetics may flow along the discharge paths of the guide plate and be discharged through the discharge holes to evenly discharge the cosmetics to the outside.

Another object of the present invention is to provide a cosmetic vessel including a mesh member having a mesh shape at a position corresponding to the shape of discharge paths and mounted on a top surface of the guide plate, and a discharge plate mounted on a top surface of the mesh member, so that cosmetics may flow along the discharge paths in a radial direction and at the same time pass through the mesh member, and be exposed to the outside through the discharge holes of the discharge plate to cause the cosmetics to be discharged to the top surface of the discharge plate to the without splashing.

Another object of the present invention is to provide a cosmetic vessel including an edge path around discharge paths of a guide plate and a sealing member mounted on the edge path to prevent cosmetics from being leaked to the outside when the cosmetics move along the discharge paths of the guide plate.

Another object of the present invention is to provide a cosmetic vessel discharging cosmetics by using an airless pump instead of a conventional impregnated sponge so that a user may repeat discharging the cosmetics by using the pump to reduce the remaining amount of the cosmetics and prevent the cosmetics from contacting air and thus being volatilized to thereby increase user satisfaction.

Another object of the present invention is to provide a container vessel including a discharge plate formed of a metal, such as a stainless steel, to secure antimicrobial properties and hygiene, allow the cosmetics to be easily removed to keep the cosmetic vessel clean even when a top surface of the discharge plate is stained with the cosmetics, and cool the cosmetics with the metallic discharge plate to provide a cooling effect to a user's skin applied with the cosmetics, the discharge plate having the top surface plated with chromium to prevent the discharge plate from wearing down when friction is caused by the cosmetics.

Technical Solution

In accordance with an aspect of the present invention, there is provided a cosmetic vessel, including a discharge unit discharging cosmetics to an outside, and a discharge plate provided at one side of the discharge unit from which the cosmetics are discharged, including at least one discharge hole, and formed of a metal.

Particularly, the discharge unit may be a pump.

Particularly, the discharge plate may include the metal of SUS 300 series.

Particularly, the discharge plate may include an SUS 304 material.

Particularly, the discharge plate may include at least one of materials of 301L, 304L, 304LN, 304N1, 304J1, 305EG, 309S, 310S, 316, 316L, 316LN, 316Ti, 317L, 321, 347, 329J3L and 329LD.

Particularly, the discharge plate may have a thickness ranging from 0.1 to 1 mm.

Particularly, the discharge plate may have a thickness ranging from 0.2 to 0.3 mm.

Particularly, the discharge plate may include at least one selected from the group consisting of iron, stainless steel, copper, zinc and aluminum, or an alloy of at least two selected from the group.

Advantageous Effects

According to the present invention, a cosmetic vessel discharges liquid cosmetics by an airless pump and allows a user to apply the cosmetics with a puff, and the cosmetic vessel includes a mesh member with a portion having a mesh shape to prevent splashing of the cosmetics when the cosmetics are discharged upwards by the pump to allow the user to conveniently use the cosmetics.

In addition, according to the present invention, since the cosmetics are discharged to the outside through the mesh member having the mesh shape, splashing of cosmetics having a lower viscosity may be effectively prevented when the cosmetics are discharged.

In addition, according to the present invention, cosmetics discharged from the pump move in a radial direction along discharge paths of a guide plate, pass through the mesh member, and are discharged to the outside through discharge holes of a discharge plate, the cosmetics may be evenly supplied to a top surface of the discharge plate.

In addition, according to the present invention, since the cosmetic vessel includes an edge path and a sealing member around the discharge paths of the guide plate, leakage of the cosmetics to the outside of the guide plate may be prevented when the cosmetics are discharged.

In addition, according to the present invention, since the discharge plate is manufactured using an SUS 300 series stainless steel, and the top surface of the discharge plate is plated with chromium, antimicrobial properties and hygiene may be secured, and at the same time, user satisfaction may be maximized by cooling the cosmetics using the metallic discharge plate.

In addition, according to the present invention, since the discharge plate of the cosmetic vessel includes a metal having excellent thermal conductivity, when a small amount of the cosmetics corresponding to a one-time usage is discharged to the discharge plate just before the use of the cosmetics, moisture of the discharge cosmetics may be evaporated to cause a sharp reduction in temperature of the cosmetics, and heat in the cosmetics discharged to the discharge plate may be transferred to the discharge plate having excellent thermal conductivity and dissipated to remove latent heat of the cosmetics to rapidly reduce the temperature of the cosmetics, so that the temperature of the cosmetics applied to the skin just before the user applies the cosmetics may be reduced to make the user feel refreshed.

BEST MODE

Figure 1:
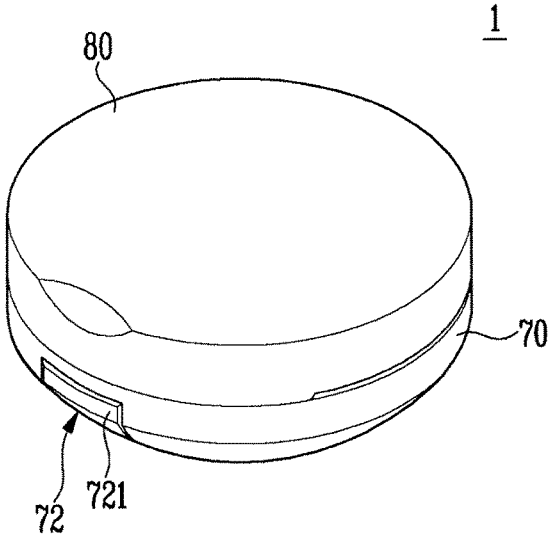
FIGS. 1 and 2 are perspective views of a cosmetic vessel according to a first embodiment of the present invention.

Objects, features and advantages of the present invention will become readily apparent by reference to the following detailed description when considered in conjunction with the accompanying drawings. The drawings are not necessarily to scale and in some instances, proportions may have been exaggerated in order to clearly illustrate features of the embodiments. Moreover, detailed descriptions related to well-known functions or configurations will be ruled out omitted in order not to unnecessarily obscure clearly describe the subject matters of the present invention. Like reference numerals in the drawings denote like elements.

Hereinafter, various embodiments of the present disclosure will be described in detail with reference to the accompanying drawings.

Figure 2:
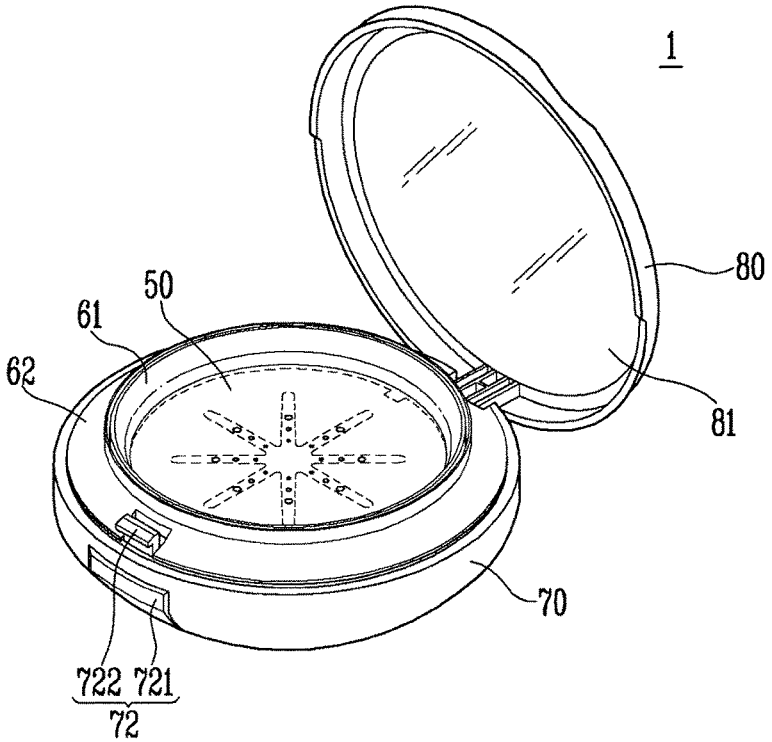

FIGS. 1 and 2 are perspective views of a cosmetic vessel according to a first embodiment of the present invention. FIG. 1 is a view illustrating a state in which a lid 80 is closed. FIG. 2 is a view illustrating a state in which the lid 80 is opened.

Figure 3:
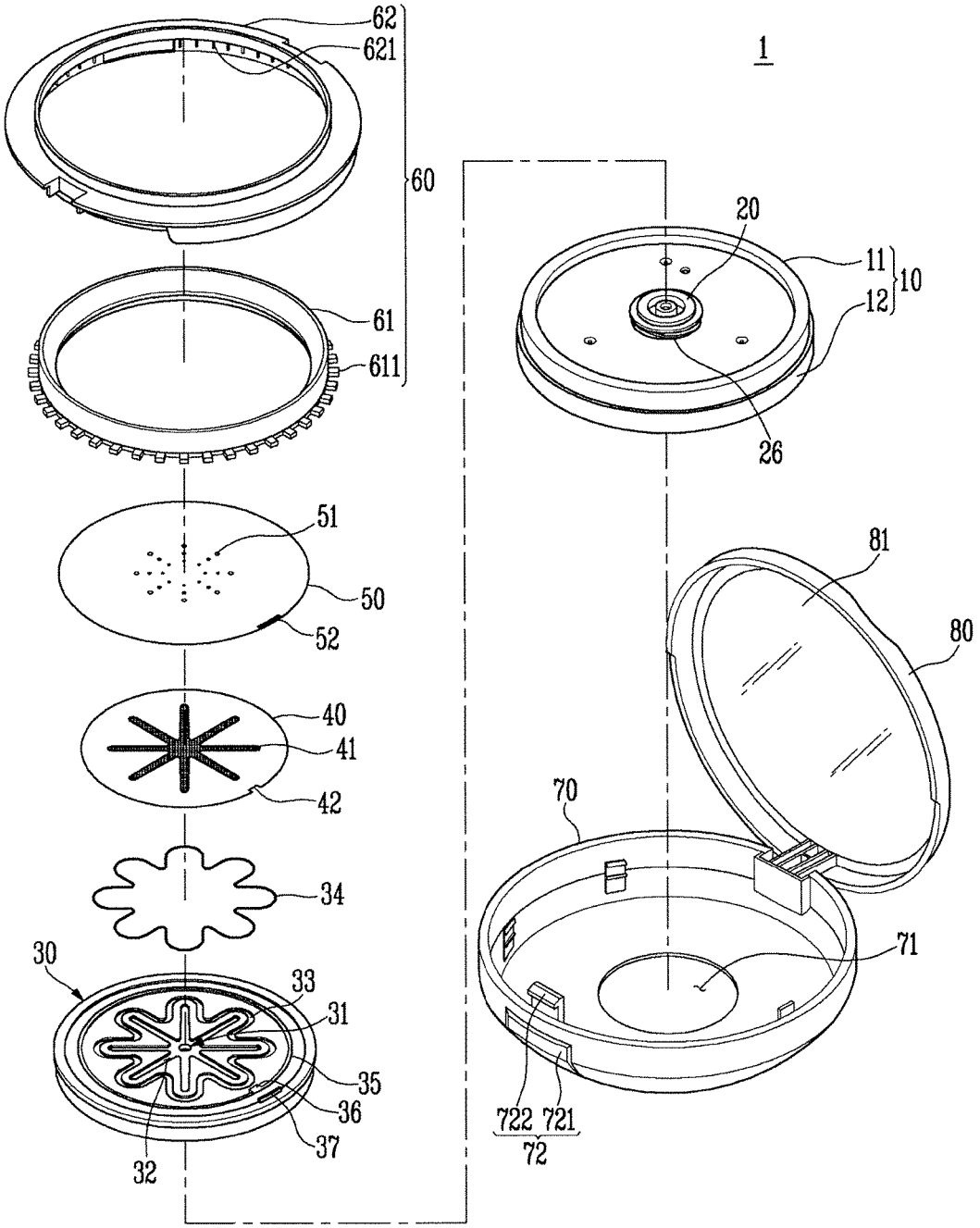
FIG. 3 is an exploded perspective view of a cosmetic vessel according to a first embodiment of the present invention.
Figure 4:
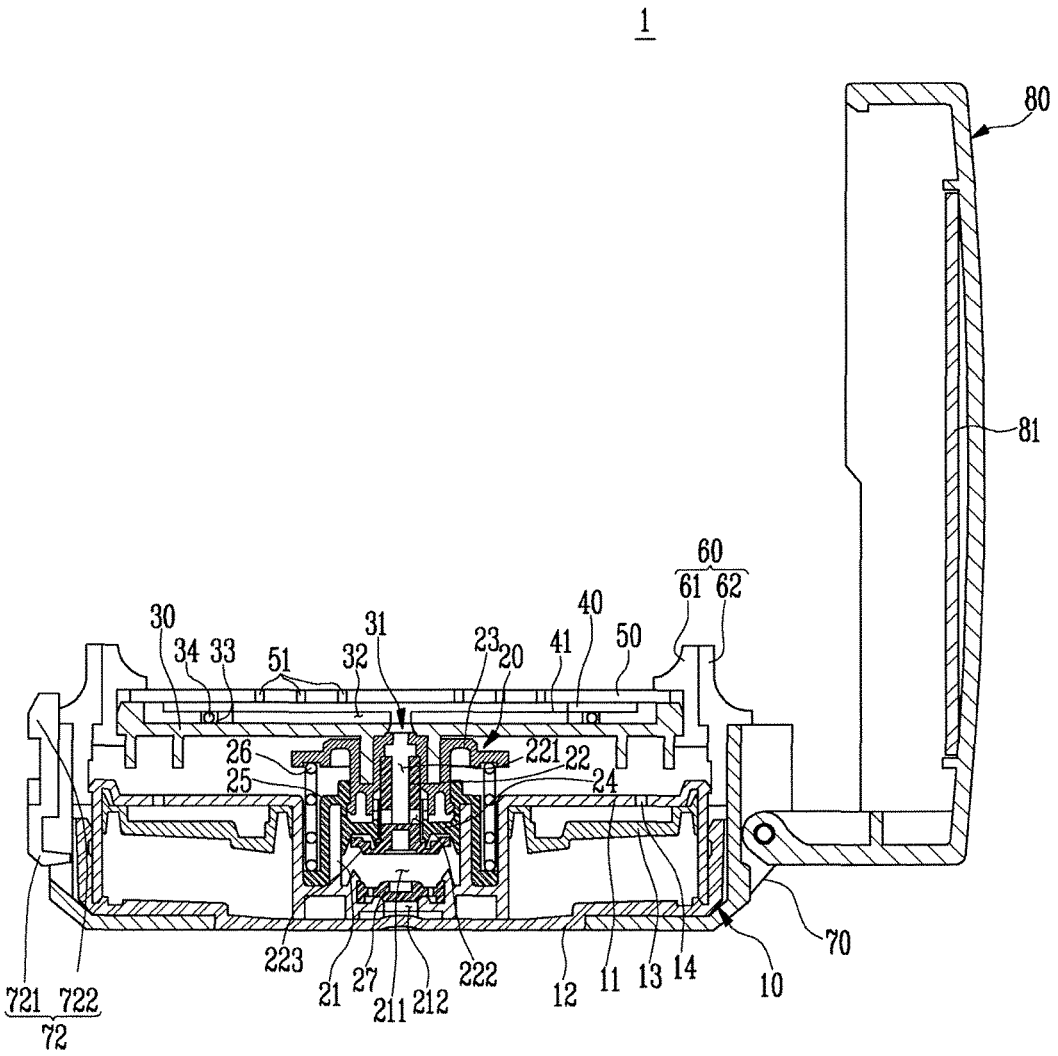
FIG. 4 is a cross-sectional view of a cosmetic vessel according to a first embodiment of the present invention.

In addition, FIG. 3 is an exploded perspective view of a cosmetic vessel according to a first embodiment of the present invention. FIG. 4 is a cross-sectional view of a cosmetic vessel according to a first embodiment of the present invention.

Referring to FIGS. 1 to 4, according to the first embodiment of the present invention, a cosmetic vessel 1 includes a vessel body 10, a pump 20, a guide plate 30, a mesh member 40, a discharge plate 50, a rim portion 60, an outer cover 70 and a lid 80.

The vessel body 10 receives cosmetics therein. The cosmetics stored in the vessel body 10 may be discharged to the outside by the pump 20 to be described below. The cosmetics may include liquid cosmetics.

The vessel body 10 may include a lower body 12 and an upper body 11. The vessel body 10 may be sealed by engaging the lower body 12 with the upper body 11. The vessel body 10 is divided into the upper and lower bodies so that the cosmetics may be easily received in the vessel body 10.

More specifically, the lower body 12 has an inwardly recessed portion. To store cosmetics in the vessel body 10, after the cosmetics are put into the lower body 12, the upper body 11 is engaged with the top portion of the lower body 12 to cover the lower body 12, so that it may be easy to fill the vessel body 10 with cosmetics.

However, the present embodiment is not limited to the vessel body 10 consisting of the lower body 12 and the upper body 11. Instead, a separate opening (not illustrated) for supplying cosmetics may be formed in the vessel body 10. Cosmetics may be received in the vessel body 10 through this opening, and the opening may then be sealed, so that the vessel body 10 may be filled with the cosmetics. In other words, the present embodiment does not particularly limit the shape and structure of the vessel body 10. Any type of vessel body may be used space for receiving cosmetics is defined in the vessel body.

The pump 20 may be provided to the vessel body 10. More specifically, the pump 20 may be located at the center of the upper part of the vessel body 10. Therefore, the cosmetics received in the vessel body 10 may be discharged in an upward direction of the vessel body 10 by the pump 20.

A press plate 13 may be formed in the vessel body 10. When the cosmetics received in the vessel body 10 are discharged by the pump 20, the volume of the vessel body 10 may be reduced to decrease internal pressure. At this time, the press plate 10 may prevent damage to the vessel body 10. In other words, since the press plate 13 descends as the cosmetics are discharged, a constant pressure may be maintained in the space where the cosmetics are stored. To allow the press plate 13 to descend, an air inlet 14 through which air is moved into the vessel from the outside may be formed at the upper part of the cosmetic vessel.

The pump 20 which is provided at the vessel body 10 may discharge the cosmetics to the outside. The pump 20 may be an airless pump and suck liquid cosmetics received in the vessel body 10 to discharge the liquid cosmetics to the outside of the vessel body 10 in the upward direction of the vessel body 10. The discharged cosmetics may pass through the guide plate 30, the mesh member 40 and the discharge plate 50 and be exposed to the outside, where a user's puff may reach the discharged cosmetics.

The pump 20 may include a cylinder 21, a piston 22 and an elevating member 23. The cylinder 21 may have a hollow 211 and be coupled to the central portion of the vessel body 10. The cylinder 21 may be formed integrally with the vessel body 10. The piston 22 and the piston ring 24 may be provided in the cylinder 21, and a first hole 212 may be formed in a bottom portion of the cylinder 21 so that cosmetics may be introduced into the first hole 212.

The piston 22 which is provided in the cylinder 21 performs an up-and-down motion to discharge the cosmetics in the vessel body 10 upwards and outwards. The hollow 221 of the piston 22 allows the cosmetics to pass therethrough. A flange 223 which protrudes outwards may be provided to a lower surface of the piston 22. In addition, a second hole 222 may be formed in an outer circumferential surface of the piston 22 so that the cosmetics may be introduced through the second hole 222.

The piston ring 24 may be provided on the outer circumferential surface of the piston 22 to seal the space between the piston 22 and the cylinder 21. The outside of the piston ring 24 may contact the cylinder 21, and the inside thereof may contact the piston 22 or the elevating member 23 to be described below. The piston ring 24 may perform an up-and-down motion by the piston 22 and the elevating member 23. However, an upward movement of the piston ring 24 may be realized by the flange 223 and restricted by the elevating member 23, while a downward movement thereof may be realized by the elevating member 23 and restricted by the flange 223.

The elevating member 23 is coupled to an upper part of the piston 22 and pressurizes the piston 22 when the elevating member 23 is moved downwards by an external force. The elevating member 23 may surround the upper part of the piston 22 and be coupled to the piston 22. In addition, the elevating member 23 may move upwards and downwards in conjunction with the piston 22. The piston ring 24 may be coupled to a lower part of the elevating member 23.

The piston ring 24 may be provided between the elevating member 23 and the cylinder 21. However, for further sealing, the pump 20 may include a covering member 25. The covering member 25 may surround the outside of the cylinder 21, cover a portion of the upper part of the cylinder 21, and closely contact a circumference of the lower part of the elevating member 23.

In addition, the pump 20 may further include an elastic member 26 to provide an upward elastic force to the elevating member 23 and the piston 22. The elastic member 26 may be a spring. An upper end of the elastic member 26 may closely contact a lower surface of the elevating member 23, and a lower end thereof may closely contact the cylinder 21 or an upper surface of the covering member 25 to push up the elevating member 23.

Hereinafter, an operating principle of the pump 20 is described below. When the elevating member 23 moves downwards, the piston 22 also moves downwards. However, since the piston ring 24 does not move downwards due to friction with an inner surface of the cylinder 21, the second hole 222 formed in the outer circumferential surface of the piston 22 moves away from the piston ring 24 and communicates with an internal space of the cylinder 21.

When the elevating member 23 continues to move downwards, the piston ring 24 is pressed by the elevating member 23 and moves downward to reduce a volume of the internal space of the cylinder 21 and increase a pressure of the internal space of the cylinder 21. Therefore, the cosmetics located in the internal space of the cylinder 21 with the increased pressure are discharged along the inside of the piston 22 through the second hole 222 formed in the outer circumferential surface of the piston 22 which communicates with the internal space of the cylinder 21. To prevent backflow of the cosmetics, the pump 20 may further include a backflow preventing member 27 in the first hole 212 formed in the lower part at the center of the cylinder 21.

On the other hand, when the elevating member 23 moves upwards by the elastic member 26, the piston ring 24 is stopped by friction with the inner surface of the cylinder 21 in the same manner as the elevating member 23 moves downwards, and the piston ring 24 moves upwards by the flange 223 of the piston 22.

When the piston ring 24 closely contacts the flange 223 of the piston 22, the second hole 222 in the outer circumferential surface of the piston 22 is closed. In addition, when the piston ring 24 moves upwards the volume of the internal space of the cylinder 21 is increased. Therefore, the internal space of the cylinder 21 has a low pressure. As a result, the cosmetics received in the vessel body 10 may be naturally introduced into the cylinder 21. By repeating the above processes, the pump 20 may allow the cosmetics received in the vessel body 10 to the outside.

However, the configuration of the pump 20 is not limited to the present embodiment, and other various methods may be used as the pump 20 in addition to the airless pump. In other words, any configuration of the pump 20 may be used as long as the cosmetics are discharged from the pump 20.

In addition, according to the present embodiment, instead of using the pump 20 as a discharge unit, a sponge impregnated with liquid cosmetics may be used. As the sponge is pressed by the guide plate 30 to be described below, the cosmetics received in the sponge may be discharged to the outside through an outlet 31 of the guide plate 30.

The sponge may include at least one selected from the group consisting of polyamide, polyester, polyether, polyurethane, polyethylene, polystyrene, polyolefin, polyvinyl alcohol, polyamide, polyester, polypropylene, polyacryl, polyvinyl chloride, epoxy resin, sponge, nylon, cotton and non-woven fabric, etc.

The guide plate 30 may be coupled to an upper part of the pump 20 and guide the cosmetics discharged by the pump 20. The guide plate 30 may be provided between the pump 20 and the mesh member 40 to be described below and coupled to the elevating member 23 of the pump 20. When the guide plate 30 moves downwards, the elevating member 23 may also move downwards accordingly.

The guide plate 30 is described in detail with reference to FIG. 5.

Figure 5:
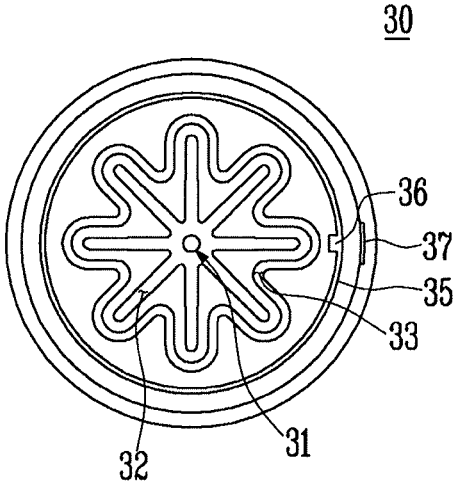
FIG. 5 is a plan view of a guide plate of a cosmetic vessel according to a first embodiment of the present invention.

FIG. 5 is a plan view of a guide plate of a cosmetic vessel according to a first embodiment of the present invention. Referring to FIG. 5, the outlet 31 may be formed in the guide plate 30 of the cosmetic vessel 1 according to the first embodiment of the present invention at a position corresponding to an outlet of the pump 20. The outlet of the pump 20 refers to the hollow 221 of the piston 22. The outlet 31 may be located at the center of the guide plate 30.

In addition, the guide plate 30 may further include discharge paths 32 which communicate with the outlet 31 and are radially formed on the basis of the outlet 31. The cosmetics pass through the hollow 221 in the piston 22 and are discharged through the outlet 31 of the guide plate 30. However, discharge holes 51 may not be formed in the discharge plate 50 at a position corresponding to the outlet 31. In other words, upward movements of the cosmetics discharged upwards through the outlet 31 of the guide plate 30 are blocked by the discharge plate 50.

The cosmetics flow radially along the discharge paths 32. Since the outlet 31 does not communicate with the outside, the discharge of the cosmetics may be prevented from being concentrated at the central part of the discharge plate 50 when the pump 20 operates.

The plurality of discharge paths 32 may be formed in a radial direction. In FIG. 5, eight discharge paths 32 are illustrated. However, the number of discharge paths 32 is not limited thereof. Since the discharge paths 32 has radial symmetrical, the cosmetics may be evenly discharged.

In addition, the guide plate 30 may further include an edge path 33 formed around the discharge paths 32. The cosmetics are discharged by the pump 20 and flow along the discharge paths 32. When the cosmetics more than the user needs are discharged, the cosmetics may leak along an outer surface of the guide plate 30 to contaminate the vessel body 10, and a user's hand holding the cosmetic vessel may be stained with the cosmetics to make the user feel unpleasant. Therefore, according to the present embodiment, since the edge path 33 is formed around the discharge paths 32, when the cosmetics flow over the discharge paths 32, the edge path 33 may prevent the cosmetics from being leaked to the outside.

The edge path 33 may be separated from the discharge paths 32 so as not to communicate with the discharge paths 32. Since the discharge paths 32 are formed in a radial direction, the edge path 33 may be in the shape of a flower or a circle which surrounds the radial discharge paths 32. In other words, when the edge path 33 is viewed from top, the discharge paths 32 may protrude outwards at positions where the discharge paths 32 are formed and protrude inwards at positions where the discharge paths 32 are not formed.

A sealing member 34 may be mounted on the edge path 33. The sealing member 34 may be formed of a rubber or the like and have the same flower shape or circular shape as the edge path 33. Since the sealing member 34 is arranged on the edge path 33, even when the cosmetics reach the edge path 33, the cosmetics may be blocked by the sealing member 34, so that cosmetics may not be discharged to the outside of the guide plate 30.

Figure 12:
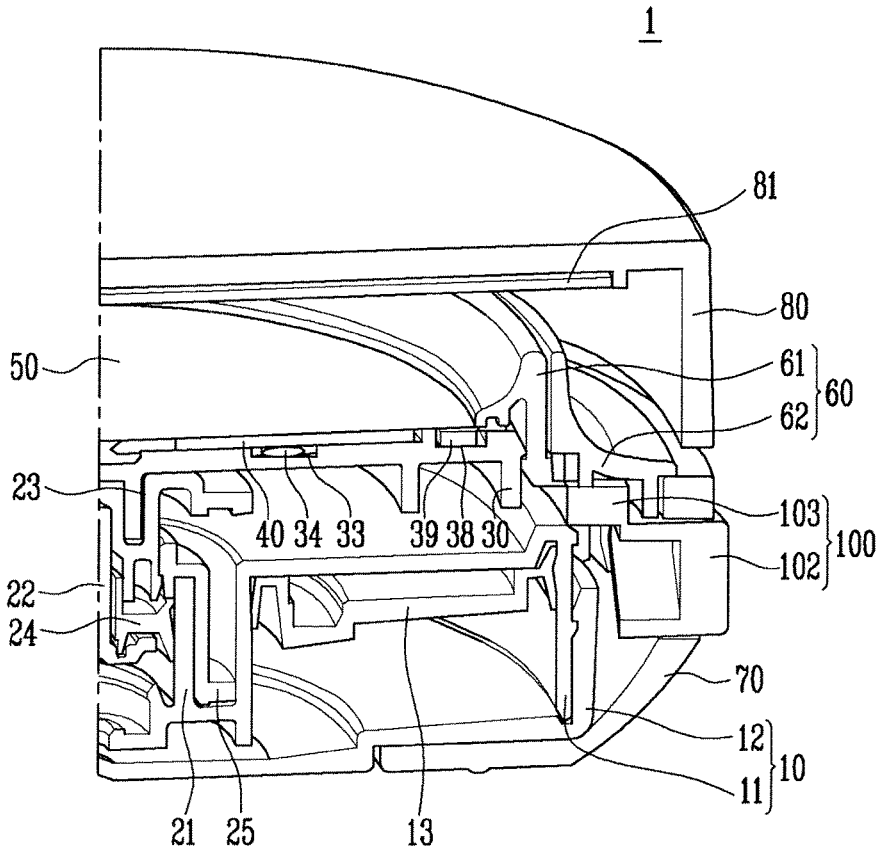
FIG. 12 is a cross-sectional view of a cosmetic vessel according to a fourth embodiment of the present invention.

According to the present embodiment, the guide plate 30 may further include an auxiliary edge path 38 having a circular shape, as shown in FIG. 12, outside the edge path 33. A packing material 39 having a circular shape, as shown in FIG. 12, may be provided on the circular auxiliary edge path 38. The circular packing material 39 may include a foam material, such as foam rubber or urethane foam, and prevent leakage of the cosmetics together with the sealing member 34. Therefore, according to the present embodiment, the cosmetics may be primarily sealed by the sealing member 34 provided on the edge path 33 and secondarily sealed by the packing material 39 provided on the auxiliary edge path, the cosmetics discharged from the pump 20 may be completely prevented from being leaked to the outside by a double sealing structure.

The mesh member 40 may be provided at one side of the pump 20 where the cosmetics are discharged. At least portion of the mesh member 40 may be formed in a mesh shape. The mesh member 40 may be provided at the upper part of the pump 20. More specifically, the mesh member 40 may be mounted on a top surface of a guide member. A guide rib 35 may be formed on the guide plate 30 to mount the mesh member 40 thereon. The mesh member 40 may be mounted in the guide rib 35 of the guide plate 30.

The mesh member 40 is described in detail with reference to FIG. 6.

Figure 6:
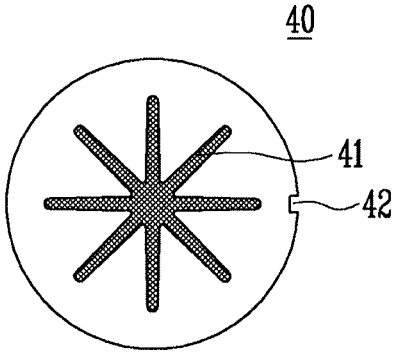
FIG. 6 is a plan view of a mesh member of a cosmetic vessel according to a first embodiment of the present invention.

FIG. 6 is a plan view of a mesh member of a cosmetic vessel according to the first embodiment of the present invention. As shown in FIG. 6, according to the first embodiment of the present invention, a groove 42 is formed at one side of the mesh member 40 of the cosmetic vessel 1, and a protrusion 36 is formed in the guide rib 35 of the guide plate 30, so that the mesh member 40 may be mounted in the guide rib 35 when the groove 42 is engaged with the protrusion 36. In other words, when the mesh member 40 is coupled to the guide member, an angle at which the mesh member 40 is mounted may be determined by the groove 42 and the protrusion 36. On the other hand, a protrusion may be formed on the mesh member 40, and a groove may be formed in the guide plate 30, whereby the angle at which the mesh member 40 is mounted may be determined.

The angle at which the mesh member 40 is mounted refers to a predetermined angle at which the mesh member 40 is mounted onto the guide plate 30, among angles at which the mesh member 40 rotates on the basis of a line which passes through the center of the mesh member 40 in a vertical direction.

The angle at which the mesh member 40 is mounted is determined so that the radially formed discharge paths 32 of the guide plate 30 and the mesh portion 41 of the mesh member 40 may match with each other. When the mesh portion 41 of the mesh member 40 has a circular shape covering the discharge paths 32, it may not be necessary to determine the angle at which the mesh member 40 is mounted. However, since the mesh portion 41 of the mesh member 40 has a circular shape, when the mesh portion 41 tightly contacts the edge path 33, the cosmetics may be transferred via the mesh portion 41 to the edge path 33 from the discharge paths 32. As a result, a sealing effect may be deteriorated.

Therefore, the mesh portion 41 may have a shape and size to cover all the discharge paths 32 and not to correspond to the edge path 33. In other words, more specifically, when the edge path 33 has a flower shape, the mesh portion 41 may have a radial shape. The angle at which the mesh member 40 is mounted may be determined by the groove 42 and the protrusion 36. When the edge path 33 has a circular shape, the mesh portion 41 may have a circular shape, and it may not be necessarily to determine the angle at which the mesh member 40 is mounted. However, although the edge path 33 has a circular shape, if the mesh portion 41 has a radial shape, the mesh portion 41 may necessarily correspond to a discharge path, the angle at which the mesh member 40 is mounted may be necessarily determined. However, since a plurality of angles at which the mesh member 40 is mounted may be determined by the number of discharge paths 32, there may be provided a plurality of grooves 42 and a plurality of protrusions 36.

As described above, since the mesh portion 41 is formed in the mesh member 40, the liquid cosmetics discharged through the guide plate 30 may pass through the mesh portion 41, so that the mesh member 40 may prevent splashing of cosmetics. In other words, since the mesh portion 41 of the mesh member 40 may slightly block movements of the cosmetics, even when the user operates the pump 20 to discharge the cosmetics to the outside, the cosmetics may gently flow along the discharge holes 51 of the discharge plate 50 without splashing. The mesh portion 41 of the mesh member 40 may include fiber such as polyester, nylon, wool, and cotton, or mixed yarns, or various materials such as iron, zinc, copper, or an alloy thereof, and plated metals. Also, the mesh portion 41 may be appropriately formed in consideration of elements and viscosity of the contents, purpose and product safety.

Therefore, according to the present embodiment, when the cosmetics are discharged by the pump 20, since the mesh portion 41 of the mesh member 40 interrupts discharge of the cosmetics, the cosmetics discharged to the outside may be evenly supplied to the discharge plate 50 without splashing. Accordingly, according to the present embodiment, a spaced used thereby may not be contaminated, and user convenience may be improved.

The discharge plate 50 may be provided at the top surface of the mesh member 40 and include the plurality of discharge holes 51. The discharge plate 50 may include a metallic material such as anti-rust iron, stainless steel, copper, zinc, tin, and aluminum, an alloy thereof, and plated metals. When the discharge plate 50 is plated with anti-corrosive, anti-fouling, and antimicrobial metals, for example, chromium, copper, silver, or gold, beauty and elegance are added so that users may feel that the discharge plate 50 is sophisticated. At the same time, the discharge plate 50 may be plated with materials which satisfy hygiene requirements. The discharge holes 51 may be provided at a position corresponding to the mesh portion 41 of the mesh member 40 or the discharge paths 32 of the guide plate 30.

The discharge plate 50 may have a thickness of 0.1 to 1 mm (preferably, 0.2 mm to 0.3 mm) and include metal having excellent corrosion resistance and rust resistance, such as aluminum, aluminum alloy, and stainless steel, or ceramics.

More specifically, the discharge plate 50 may include SUS 304 among SUS 300 series having good corrosion resistance, acid resistance and heat resistance. More particularly, to improve antimicrobial resistance and hygienic conditions, the discharge plate 50 may include 304J1.

However, according to the present embodiment, the material of the discharge plate 50 is not limited thereto. The discharge plate 50 may include at least one of 301L, 304L, 304LN, 304N1, 305EG, 309S, 310S, 316, 316L, 316LN, 316Ti, 317L, 321, 347, 329J3L, and 329LD including 304 series.

Therefore, according to the present embodiment, by using the discharge plate 50 made of a SUS 300 series stainless steel, the top surface of the discharge plate 50 on which the cosmetics discharged by the pump 20 are placed and remain may be kept clean, and corrosion may be effectively prevented.

In addition, according to the present embodiment, by using the metallic discharge plate 50, the discharge plate 50 may efficiently dissipate heat, so that a cooling effect may be obtained to reduce the temperature of the cosmetics.

According to the present embodiment, as described above, an impregnated sponge may replace the pump 20. When the impregnated sponge is used, the metallic discharge plate 50 may be used to pressurize the impregnated sponge.

However, when the discharge plate 50 directly presses the impregnated sponge, as the impregnated sponge keeps contacting the discharge plate 50, the temperature of the discharge plate 50 is in equilibrium with the temperature of the impregnated sponge. As a result, when the cosmetics are discharged from the impregnated sponge, the discharge plate 50 may not cool down the cosmetics. In addition, air may be introduced into the impregnated sponge through the discharge holes 51 of the discharge plate 50 to contaminate the cosmetics received in the impregnated sponge.

However, according to the present embodiment, even when the impregnated sponge is used, since the guide plate 30 and the mesh member 40 are disposed between the discharge plate 50 and the impregnated sponge, the discharge plate 50 may be separated from a discharge unit, such as the impregnated sponge to avoid contamination of cosmetics as described above.

Accordingly, according to the present embodiment, since the discharge plate 50 is separated from the discharge unit for discharging the cosmetics, the discharge plate 50 may maintain a lower temperature than the cosmetics, so that the cosmetics discharged through the discharge unit may cool down when contacting the discharge plate 50, which may make the user feel extremely satisfied.

In addition, according to the present embodiment, since the airless pump 20 may be used as a discharge unit, even when air is introduced through the discharge holes 51 formed in the discharge plate 50, the airless pump 20 may prevent air from being transmitted to the cosmetics received in the pump 20 to thereby protect the cosmetics against contamination. In addition, according to the present embodiment, when the pump 20 is used, the remaining usage may be reduced to approximately 5% as compared when an impregnated sponge is used.

The cosmetics remain on the top surface of the discharge plate 50. When the user rubs the cosmetics remaining on the top surface of the discharge plate 50 with a puff or the like, the top surface of the discharge plate 50 may wear down due to powder contained in the cosmetics. Therefore, according to the present embodiment, by coating the top surface of the discharge plate 50 or plating it with a predetermined material, even when the user rubs the top surface of the discharge plate 50 to pick up the cosmetics, deterioration in durability of the discharge plate 50 may be prevented.

The discharge plate 50 may be plated with a different metal from the metal forming the discharge plate 50. For example, the discharge plate 50 may be plated with chromium. More specifically, the discharge plate 50 may be plated with trivalent chromium or hexavalent chromium.

As described above, according to the present embodiment, since the discharge plate 50 is formed of a metallic material and at least one surface thereof is plated with chromium, hygiene, anti-microbial resistance and durability may be ensured. In addition, the cosmetics remaining on the discharge plate 50 may be easily cleaned to keep the discharge plate 50 clean and increase user convenience. In other words, according to the present embodiment, since a separate member is not placed on the top surface of the discharge plate 50, the top surface of the discharge plate 50 may be directly exposed to the outside.

The discharge paths 32 of the guide plate 30 are radially formed, and the mesh portion 41 of the mesh member 40 covers the discharge paths 32 of the guide plate 30. Thus, the discharge holes 51 may be radially formed in substantially the same manner as the discharge paths 32.

The radially formed discharge holes 51 may increase in diameter as the discharge holes 51 are away from the center of the discharge plate 50. The cosmetics are discharged from the center by the pump 20 and flow along the discharge paths 32 of the guide plate 30. Therefore, a rate of flow of the cosmetic may gradually decrease from the center. Therefore, when the discharge holes 51 have the same diameter, the cosmetics may not be unevenly spread over the top surface of the discharge plate 50. Thus, the discharge holes 51 may increase in diameter as the discharge holes 51 are away from the center.

As described above, the discharge holes 51 may not be formed in the central portion of the discharge plate 50. When the discharge holes 51 are formed at the central portion of the discharge plate 50, if the guide plate 30 is strongly pressed, the cosmetics may pass through the outlet 31 of the guide plate 30, the mesh portion 41 of the mesh member 40, and the discharge holes 51 of the discharge plate 50 at the same time and therefore splash up.

The discharge holes 51 formed in the discharge plate 50 may have a very small diameter ranging from 0.1 to 1 mm. When the discharge holes 51 have a smaller diameter, the user may precisely control the amount of cosmetics discharged to the upper part of the discharge plate 50 by the pump 20, and foreign matters may not be introduced therein through the discharge holes 51.

More specifically, the discharge holes 51 may be radially provided and separated from each other at 45 degree intervals on the basis of the center of the discharge plate 50. Three discharge holes 51 may be arranged next to each other in a predetermined direction away from the center of the discharge plate 50. These three discharge holes 51 arranged next to each other may sequentially have diameters of 0.3 mm, 0.4 mm, and 0.5 mm from the center of the discharge plate 50 towards the outside.

Therefore, according to the present embodiment, since the discharge plate 50 including the discharge holes 51 having the above-described very small diameters are used for the airless pump 20, the cosmetics may be prevented from contacting with air, so that some of the materials included in the cosmetics may be sufficiently prevented from being volatilized.

As described above, since the discharge holes 51 have very small diameters, when the discharge plate 50 is manufactured by injection molding, it may be difficult to accurately manufacture the discharge holes 51. Therefore, according to the present embodiment, after the discharge plate 50 is manufactured, the discharge holes 51 may be formed by etching, so that the discharge holes 51 having a diameter of 0.1 mm may be manufactured.

A protrusion 37 may be formed at one side of the guide plate 30, and a coupling hole 52 may be formed in the discharge plate 50 so that the discharge holes 51 of the discharge plate 50 may correspond to the radially formed discharge paths 32 of the guide plate 30. The protrusion 37 is engaged with the coupling hole 52. In other words, the discharge plate 50 may be mounted on the guide plate 30 by engaging the protrusion 37 of the guide plate 30 with the coupling hole 52. In this manner, as described above in connection with the mesh member 40, an angle at which the discharge plate 50 is mounted may be determined. However, a detailed description thereof will be omitted since it is given earlier in connection with the groove 42 and the protrusion 36.

The rim portion 60 may be coupled to the upper part of the guide plate 30 and the vessel body 10. The rim portion 60 may include an inner rim portion 61 and an outer rim portion 62. The inner rim portion 61 may surround the edge of the discharge plate 50 and be coupled to the guide plate 30 to fix the guide plate 30, the mesh member 40, and the discharge plate 50 while being compressed. The inside of the inner rim portion 61 may be penetrated to expose the discharge plate 50 to the outside, so that the cosmetics discharged to the top surface of the discharge plate 50 may be exposed to the outside.

The inner rim portion 61 may be formed integrally with the discharge plate 50 since when the inner rim portion 61 moves downwards, the discharge plate 50 also moves downwards. In this example, the material of the inner rim portion 61 may be similar to or the same as that of the discharge plate 50. For example, the inner rim portion 61 may include iron, stainless steel, copper, zinc, tin, and aluminum, an alloy thereof, or plated metals. In addition, in a similar manner as the discharge plate 50, the inner rim portion 61 may include chromium, copper, silver, or gold in order to achieve beauty and elegance.

The outer rim portion 62 may be provided to the outside of the inner rim portion 61 and coupled with the vessel body 10. However, the outer rim portion 62 may not be fixed to the inner rim portion 61, allow elevating or lowering of the inner rim portion 61, and surround the outside of the inner rim portion 61. To this end, inner teeth 611 may be formed on an outer surface of the inner rim portion 61, and outer teeth 621 having a shape corresponding to the inner teeth 611 of the outer rim portion 62 may be formed on an inner surface of the inner rim portion 61, so that the outer rim portion 62 may restrict the rotation of the inner rim portion 61 and allow the elevating and lowering thereof.

A portion engaged with a hinge structure of a lid 80 to be described below and a portion corresponding to a latching portion 72 may be depressed into a side surface of the outer rim portion 62 to avoid interference between components.

The outer rim portion 62 may be coupled to an outer cover 70 to be described below. The inner rim portion 61 may be raised or lowered on the basis of the outer rim portion 62 to operate the pump 20. In other words, when the user grips the outer cover 70 and presses the discharge plate 50 in the inner rim portion 61 with a puff (not illustrated), the inner rim portion 61 coupled to the discharge plate 50 in the outer rim portion 62 coupled to the outer cover 70 moves downwards, and the guide plate 30 also moves downwards to cause the pump 20 to operate, so that the cosmetics may be provided to the top surface of the discharge plate 50 and the inside of the inner rim portion 61. Therefore, the user may apply the cosmetics by picking up the cosmetics exposed on the top surface of the discharge plate 50 with the puff.

The outer cover 70 is configured to surround the vessel body 10. The outer cover 70 has a space in which the vessel body 10 is mounted. However, an opening 71 may be formed in a lower part of the outer cover 70 to expose the vessel body 10. The user pushes up the vessel body 10 through the opening 71 of the outer cover 70 to separate vessel body 10 therefrom, so that the vessel body 10 may be replaced with a new one.

The top surface of the outer cover 70 may be covered by the outer rim portion 62, the inner rim portion 61 and the discharge plate 50 in a sequential manner from the outside to the center. Thus, from the outside, the user cannot see the guide plate 30, the mesh member 40, and the pump 20. Therefore, according to the present embodiment, the beauty of the cosmetic vessel may be improved to increase user satisfaction.

The outer cover 70 may include the latching portion 72. The latching portion 72 may be coupled with the lid 80 to block the opening of the lid 80. A button 721 and a latch 722 may be formed in a single body. In other words, when the user pushes the button 721, the latch 722 also moves in a direction in which the button 721 is pressed. In this manner, the latching portion 72 may control the opening and closing of the lid 80 by separating the latch 722 from the lid 80.

The lid 80 opens and closes one side of the outer cover 70 (herein, upper side). One side of the lid 80 may be coupled to the outer cover 70 using a hinge. The lid 80 may rotate on the basis of the center of the hinge to open the upper side of the outer cover 70. The lid 80 may be fixed while sealing the upper side of the outer cover 70 by the latching portion 72.

The lid 80 may be coupled to the outer cover 70 using the hinge. A spring may be provided to the hinge structure so that the lid 80 may be automatically opened when the lid 80 is released from the latching portion 72.

A mirror 81 may be provided to the inside of the lid 80. While the user looks into the mirror 81 after opening the lid 80, the user may discharge the cosmetics from the vessel body 10 by pressurizing the discharge plate 50 or the inner rim portion 61.

As described above, according to the present embodiment, when the cosmetics are discharged from the pump 20, the movements of the cosmetics are blocked by the mesh member 40 to prevent the cosmetics from spurting from the top surface of the discharge plate 50, so that the user may use the cosmetics with convenience and cleanliness.

Figure 7:
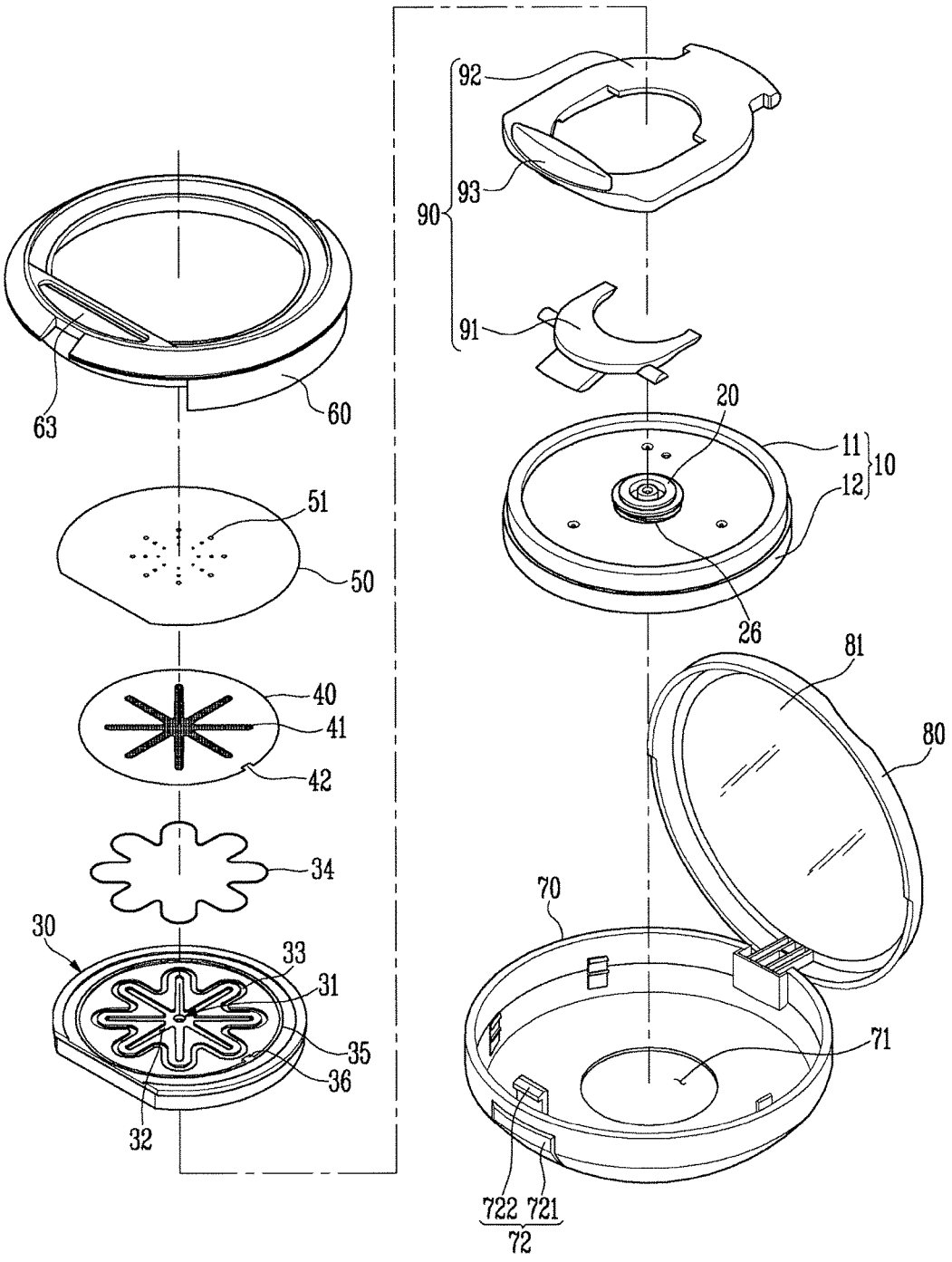
FIG. 7 is an exploded perspective view of a cosmetic vessel according to a second embodiment of the present invention.
Figure 8:
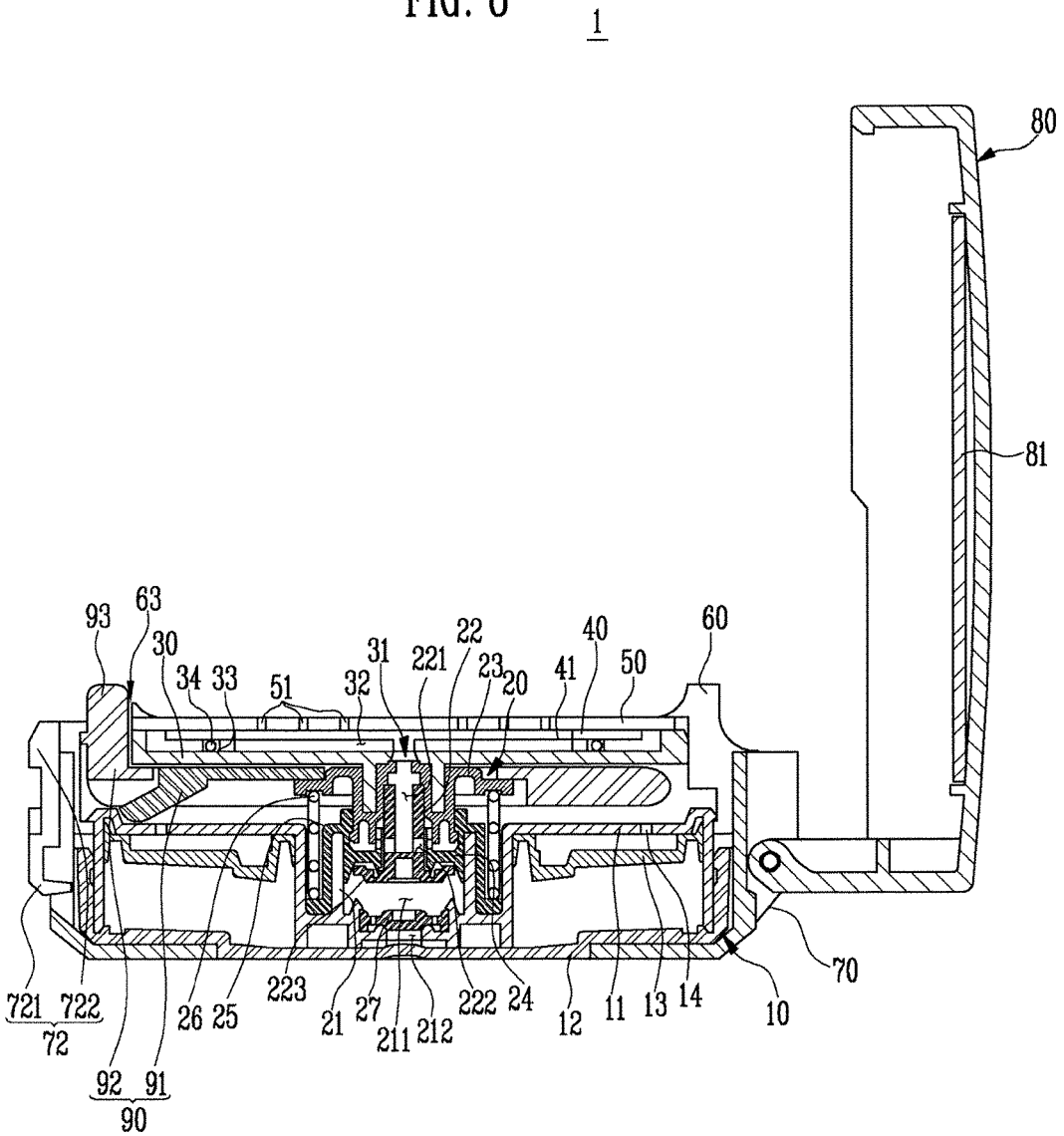
FIG. 8 is a cross-sectional view of a cosmetic vessel according to a second embodiment of the present invention.

FIG. 7 is an exploded perspective view of a cosmetic vessel according to the second embodiment of the present invention. FIG. 8 is a cross-sectional view of a cosmetic vessel according to the second embodiment of the present invention.

Referring to FIGS. 7 and 8, according to the second embodiment of the present invention, the cosmetic vessel 1 may further include a button portion 90.

Hereinafter, the differences between the present embodiment and the first embodiment will be described in detail. Although the configuration of the present embodiment is denoted by the same reference numerals as those of the first embodiment, it does not necessarily mean that both embodiments have the same configuration.

The guide plate 30 may have a disc shape with a cut-off portion at one side thereof to ensure a space in which the button portion 90 to be described below is located. In this case, the protrusion described above according to the first embodiment may be removed. However, the outlet 31 and the discharge paths 32 formed on the upper part of the guide plate 30 may be the same as those of the first embodiment.

The discharge plate 50 may have a disc shape with a cut-off portion at one side like the guide plate 30, and the coupling hole 52 is omitted. However, since each of the guide plate 30 and the discharge plate 50 has a disc shape with a cut-off portion at one side thereof, it may be possible to smoothly align the guide plate 30 and the discharge plate 50 without providing the protrusion or the coupling hole included in the first embodiment.

The rim portion 60 may be coupled to the upper part of the guide plate 30 and the vessel body 10. According to the present embodiment, since the pump 20 may be operated using the button portion 90, the rim portion 60 may be formed as a single body unlike the rim portion 60 according to the first embodiment. In addition, since the rim portion 60 may be firmly fixed to the vessel body 10, it may be impossible to rise or lower the rim portion 60.

A through hole 63 may be formed in the rim portion 60 so that one side of the button portion 90 to be described below may be exposed to the outside. Since the button portion 90 causes the pump 20 to operate when the protruding portion 93 is pressed by the user, the protruding portion 93 may be exposed to the outside for the user to press. A description thereof will be given below. Therefore, the rim portion 60 includes the through hole 63 so that the user may easily access the button portion 90.

The button portion 90 is provided above the pump 20 and causes the pump 20 to operate. When a portion exposed through the through hole 63 of the rim portion 60 is pressed by the user, the button portion 90 causes the elevating member 23 of the pump 20 to move downwards so that the cosmetics received in the pump 20 may be discharged to the outside. The button portion 90 may include an auxiliary button 91 and a primary button 92.

One end of the auxiliary button 91 is mounted on a top surface of the elevating member 23, and the other end thereof may be inclined downwards so that the auxiliary button 91 may be mounted on the vessel body 10 (specifically, upper body 11) to provide an elastic force to the primary button 92 to be described below.

The primary button 92 may be mounted on an upper part of the auxiliary button 91, a protruding portion 93 is formed at one end thereof, and a portion thereof may be mounted on the top surface of the elevating member 23. A portion of the top surface of the elevating member 23 on which one end of the auxiliary button 91 is mounted and another portion thereof on which the portion of the primary button 92 is mounted may be located opposite to each other. Thus, when the elevating member 23 moves downwards by the primary button 92 and the auxiliary button 91, the elevating member 23 may stably move downwards without being tilted.

The protruding portion 93 of the primary button 92 may be exposed through the through hole 63 of the rim portion 60 for the user to press. When the user presses the protruding portion 93, a portion of the primary button 92 corresponding to the top surface of the elevating member 23 moves downwards, and a portion of the auxiliary button 91, pressed by the primary button 92, corresponding to the top surface of the elevating member 23 may move downwards. Therefore, as the elevating member 23 moves downwards by the primary button 92 and the auxiliary button 91, the cosmetics may be discharged to the discharge plate 50.

According to the present embodiment, instead of the button portion 90, a button portion (not illustrated) which extends from the side of the vessel body 10 causes the pump 20 to operate when being pressed by the user. In addition, according to the present embodiment, various structures may be used to operate the pump 20. For example, the pump 20 may be operated by rotation of a screw.

As described above, unlike first embodiment, according to the present embodiment, the rim portion 60 does not move downwards, and the cosmetics are discharged to the discharge plate 50 by using the button portion 90. Therefore, abnormal discharge caused by the discharge holes 51 clogged by the puff when the user presses the discharge plate 50 with the puff to discharge the cosmetics according to the first embodiment may be avoided, and the discharge of the cosmetics may become easier, thereby increasing user satisfaction.

Figure 9:
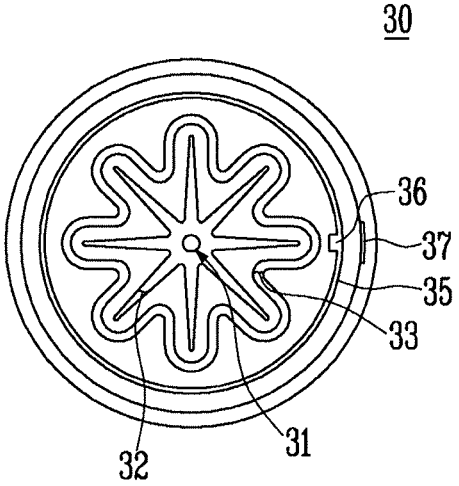
FIG. 9 is a plan view of a guide plate of a cosmetic vessel according to a third embodiment of the present invention.
Figure 10:
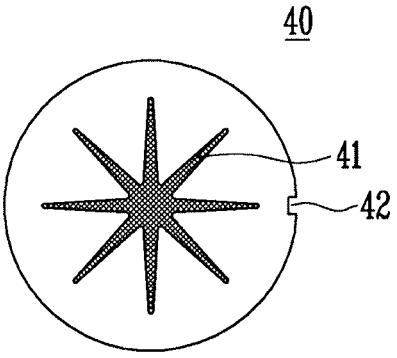
FIG. 10 is a plan view of a mesh member of a cosmetic vessel according to a third embodiment of the present invention.

FIG. 9 is a plan view of a guide plate of a cosmetic vessel according to a third embodiment of the present invention. FIG. 10 is a plan view of a mesh member of a cosmetic vessel according to a third embodiment of the present invention.

Referring to FIGS. 9 and 10, according to the third embodiment of the present invention, the discharge paths 32 of the guide plate 30 and the mesh portion 41 of the mesh member 40 of the cosmetic vessel may be different from those of the earlier described embodiments. Hereinafter, the differences between the present embodiment and the first and embodiments will be described in detail. Although the configuration of the present embodiment is denoted by the same reference numerals as those of the first and second embodiments, it does not necessarily mean that these embodiments have the same configuration.

The guide plate 30 is coupled to the upper part of the pump 20 to guide the cosmetics discharged by the pump 20. As described above with reference to the first embodiment, the guide plate 30 may include the outlet 31, the discharge paths 32 and the edge path 33. The discharge paths 32 are reduced or increased as the discharge paths 32 are away from the outlet 31 located at the center of the guide plate 30.

When the cosmetics are discharged from the pump 20, the cosmetics pass through the outlet 31, move along the discharge paths 32, and are exposed to the outside through the discharge holes 51 of the discharge plate 50. In order that the cosmetics may be discharged through the discharge holes 51 which are distant from the discharge plate 50, the cosmetics are to be sufficiently filled from the outlet 31 to one location of the discharge paths 32 (at which the discharge holes 51 distant from the center communicate with the discharge paths 32). Therefore, the amount of the cosmetics being discharged through the discharge holes 51 which are distant from the center may be not enough.

Therefore, according to the present embodiment, the discharge paths 32 are reduced as the discharge paths 32 are away from the outlet 31, so that the remaining amount of the cosmetics on the discharge paths 32 may be reduced, and a sufficient amount of cosmetics may be discharged although the discharge holes 51 of the discharge plate 50 are distant from the center of the discharge plate 50.

The mesh member 40 is provided at one side of the pump 20 where the cosmetics are discharged. At least portion of the mesh member 40 may have a mesh shape. In other words, since the cosmetics move from the mesh member 40 through the mesh portion 41 and are discharged to the outside, according to the present embodiment, splashing of the cosmetics discharged from the pump 20 may be prevented when low viscosity cosmetics are used.

The mesh portion 41 may have a shape corresponding to the discharge paths 32. In other words, the mesh portion 41 may be radially formed so as to correspond to the discharge paths and be gradually reduced or expanded (preferably reduced) away from the center. Therefore, the mesh portion 41 may sufficiently cover the discharge paths 32 to prevent splashing of the lower viscosity cosmetics.

As described above, according to the present embodiment, the discharge paths 32 of the guide plate 30 are gradually reduced away from the outlet 31, so that a sufficient amount of the cosmetics may be discharged through all discharge holes 51 formed in the discharge plate 50. As a result, user satisfaction may be increased.

Figure 11:
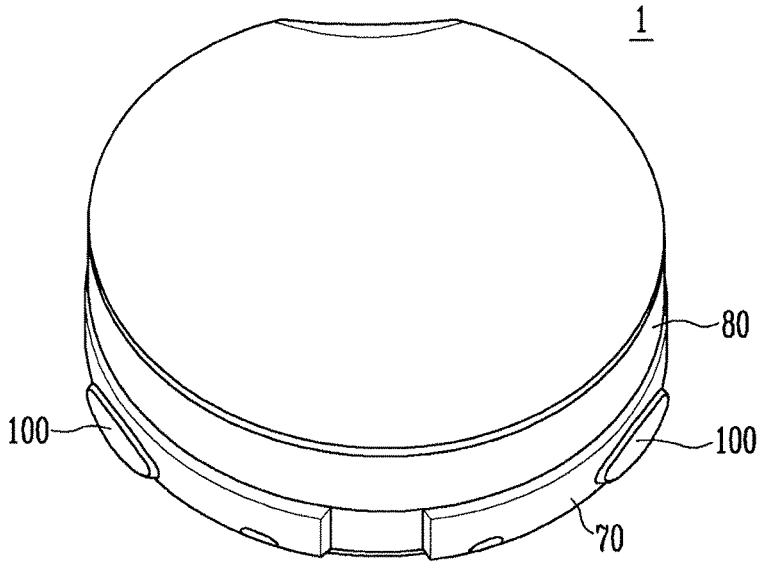
FIG. 11 is a perspective view of a cosmetic vessel according to a fourth embodiment of the present invention.
Figure 13:
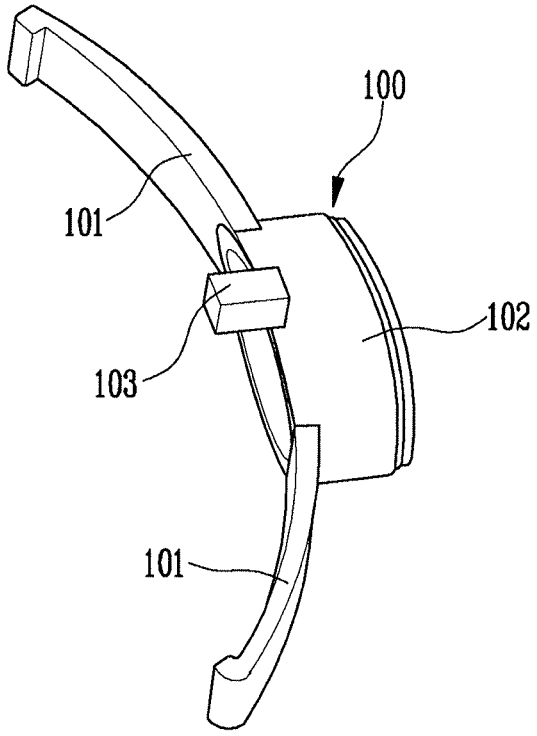
FIG. 13 is a perspective view of a locking portion of a cosmetic vessel according to a fourth embodiment of the present invention.

FIG. 11 is a perspective view of a cosmetic vessel according to the fourth embodiment of the present invention. FIG. 12 is a cross-sectional view of a cosmetic vessel according to the fourth embodiment of the present invention. FIG. 13 is a perspective view of a locking portion of a cosmetic vessel according to the fourth embodiment of the present invention.

Referring to FIGS. 11 to 13, according to the fourth embodiment of the present invention, the cosmetic vessel 1 may include a locking portion 100. The differences between the present embodiment and the first to third embodiments will be described in detail. Although the configuration of the present embodiment is denoted by the same reference numerals as those of the first to third embodiments, it does not necessarily mean that these embodiments have the same configuration.

The locking portion 100 may control the discharge of the cosmetics by the pump 20. A portion of the locking portion 100 may protrude from an outer surface of the outer cover 70 and be pressed by the user if necessary to thereby control the operations of the pump 20.

The locking portion 100 may be included to avoid inadvertent discharge of cosmetics caused by pressing the discharge plate 50 when the user rubs the cosmetics to evenly spread on the discharge plate 50 using the puff after the user presses the discharge plate 50 to discharge the cosmetics to the top surface of the discharge plate 50 from the pump 20.

Therefore, according to the present embodiment, by providing the locking portion 100, since the user is able to control the discharge of the cosmetics by pressing the locking portion 100 after a desirable amount of the cosmetics are discharged to the top surface of the discharge plate 50, the user may conveniently apply the cosmetics discharged to the discharge plate 50 with the puff.

To this end, at least one locking portion 100 may be formed at the outer cover 70 that the user grips, and any locking portion 100 may control the discharge of the pump 20. For example, the locking portions 100 may be provided at the left and right of the portion at which the outer cover 70 and the lid 80 are engaged with each other by a hinge.

The locking portion 100 includes an elastic piece 101, a protruding portion 102 and a locking protrusion 103. The elastic piece 101 may extend a predetermined length from one side (preferably both sides) of the locking portion 100 and have an elastic force. The elastic force of the elastic piece 101 may be exerted on the protruding portion 102 to cause the protruding portion 102 to protrude to the outside of the vessel body 10 when an external force is not applied.

One end of the elastic piece 101 may be connected to the protruding portion 102 to be described below, and the other end thereof may tightly contact to the outside of the vessel body 10. When the protruding portion 102 is pushed in by the user, the other end of the elastic piece 101 slides along the outer surface of the vessel body 10 to allow the protruding portion 102 to be inserted therein.

The protruding portion 102 may be exposed to the outside of the outer cover 70 and pressed by the user. To this end, a through hole (not illustrated) corresponding to the shape of the protruding portion 102 may be formed in the outer cover 70.

The protruding portion 102 may have a curved shape so that the user may conveniently press the protruding portion 102 and the cosmetic vessel may look better. In addition, since a friction surface is formed, user convenience may be increased.

An elastic force may be applied to the protruding portion 102 from elastic piece 101 in an outward direction on the basis of the center of the pump 20. The protruding portion 102 moves towards the center of the pump 20 when being pressed by the user. The locking portion 100 may be locked as the locking protrusion 103 moves in conjunction with the protruding portion 102.

The locking protrusion 103 is provided to the protruding portion 102 and prevents the discharge plate 50 from moving downwards. More specifically, when the protruding portion 102 is pressed by the user, the locking protrusion 103 may move inwards from the outside on the basis of the pump 20 to prevent the discharge plate 50 from moving downwards.

A top surface of the locking protrusion 103 tightly contacts a lower part of the inner rim portion 61 of the rim portion 60 which may move downwards to prevent the inner rim portion 61 from moving downwards and thus prevent the discharge plate 50 from moving downwards, so that the discharge of the cosmetics of the pump 20 may controlled.

According to the present embodiment, the button portion 90 according to the second embodiment may be used herein. The locking portion 100 may prevent the button portion 90 from moving downwards so as not to cause the pump 20 to operate. Since the protruding portion 102 is inserted, the locking protrusion 103 of the locking portion 100 may tightly contact a bottom surface of the button portion 90 to prevent the operations of the button portion 90.

As described above, according to the present embodiment, since the user easily controls the operations of the pump 20 by using the locking portion 100 after the cosmetics are discharged to the discharge plate 50, the cosmetics may not be discharged even when the user taps the cosmetics discharged to the discharge plate 50 to evenly spread the cosmetics, so that waste of the cosmetics may be avoided to significantly increase user satisfaction.

Hereinafter, based on the specific experimental data, a cooling effect of the cosmetic vessel 1 according to the present invention is proved and described.

Figure 14:
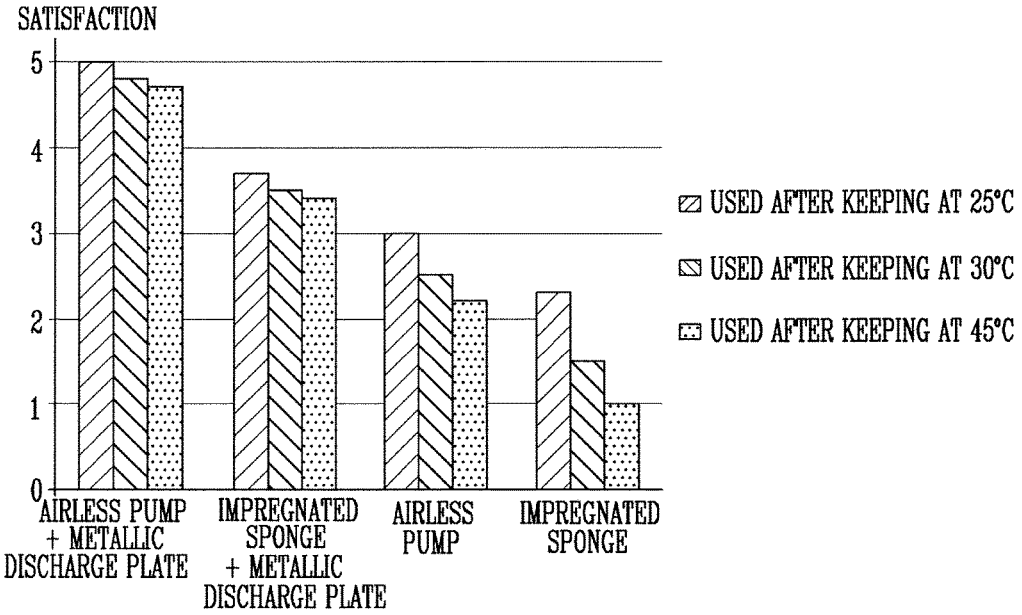
FIG. 14 is a graph showing user satisfaction with a cooling effect of a cosmetic vessel according to the present invention.
Figure 15:
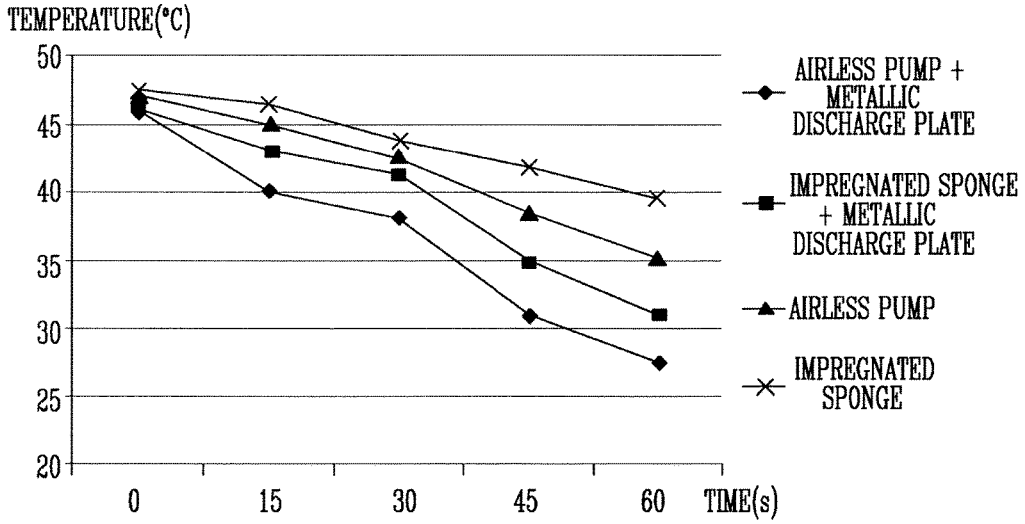
FIG. 15 is a graph showing a temperature change of a cosmetic vessel according to the present invention.

FIG. 14 is a graph showing user satisfaction with a cooling effect of a cosmetic vessel according to the present invention. FIG. 15 is a graph showing a temperature change of a cosmetic vessel according to the present invention.

Table 1 below shows user satisfaction when a user used the cosmetic vessels 1 and the conventional cosmetic vessels which were left for one minute at predetermined temperatures. More specifically, fifty users were surveyed and gave grades on a scale of zero to five, and average values were calculated. FIG. 14 is a graph of the values shown in Table 1.

TABLE 1

| | Airless pump + metallic discharge plate | Impregnated sponge + metallic discharge plate | Airless pump | Impregnated sponge |
|---|---|---|---|---|
| used after keeping at 25° C. | 5 | 3.7 | 3 | 2.3 |
| used after keeping at 30° C. | 4.8 | 3.5 | 2.5 | 1.5 |
| used after keeping at 45° C. | 4.7 | 3.4 | 2.2 | 1 |

Referring to Table 1 and FIG. 14, since the cosmetic vessel 1 according to the present invention includes the discharge unit (20) including the pump 20 (specifically, airless pump) or an impregnated sponge, and the discharge plate 50, there may be two different embodiments, depending on the type of the discharge unit 20. In addition, the conventional cosmetic vessel may be divided into a case in which cosmetics are discharged by the airless pump and a case in which cosmetics are discharged by the impregnated sponge.

It showed that the highest level of user satisfaction was achieved against the embodiment corresponding to the cosmetic vessel 1 including the airless pump 20 and the metallic discharge plate 50 when the cosmetic vessel 1 according to the present invention was used after being kept at each temperature in comparison with the other embodiment according to the present invention or the conventional cosmetic vessels.

In addition, user satisfaction with the embodiment corresponding to the cosmetic vessel 1 including the impregnated sponge and the metallic discharge plate 50 when the cosmetic vessel 1 was used after being kept at each temperature was higher than that of the conventional cosmetic vessel.

Since the metallic discharge plate 50 effectively cools the cosmetics discharged from the airless pump 20 or the impregnated sponge, the user satisfaction with the cooling effect of the cosmetic vessel 1 according to the present invention was higher than that with the conventional cosmetic vessel. On the other hand, since the conventional cosmetic vessel including either the airless pump or the impregnated sponge cannot cool the cosmetics, a lower level of user satisfaction was obtained.

The cooling effect produced by the cosmetic vessel 1 is shown with reference to Table 2 below and FIG. 15.

TABLE 2

| | 0 | 15 | 30 | 45 | 60 | (sec) |
|---|---|---|---|---|---|---|
| Airless pump + metallic discharge plate | 45.8 | 40 | 38.1 | 31 | 27.5 | Temperature |
| Impregnated sponge + metallic discharge plate | 46.4 | 43 | 41.3 | 35 | 31.1 | Temperature |
| Airless pump | 47 | 45 | 42.6 | 38.5 | 35.2 | Temperature |
| Impregnated sponge | 47.4 | 46.5 | 43.7 | 41.7 | 39.6 | Temperature |

Table 2 shows temperatures of surfaces (on which the user picks up cosmetics with a puff. The surfaces of the cosmetic vessels refer to the top surfaces of the discharge plate 50 of the cosmetic vessel 1 according to the present invention, a discharge portion of the airless pump of the conventional cosmetic vessel, and the top surface of the impregnated sponge of the conventional cosmetic vessel.) of the cosmetic vessel 1 and the conventional cosmetic vessel measured by time after the cosmetic vessel 1 and the conventional cosmetic vessel were kept at a predetermined temperature (50 degrees) for a predetermined period of time (the cosmetic vessel 1 and the conventional cosmetic vessel were kept in an incubator until the temperature of the incubator was completely transferred to each vessel for four hours in these experiments), and then left at room temperature (of 20 degrees) for one minute. An average of three values for each embodiment was calculated. FIG. 15 is a graph of the values shown in Table 2.

Referring to Table 2 and FIG. 15, as for the embodiment corresponding to the cosmetic vessel 1 including the airless pump 20 as the discharge unit 20, the temperature of the surface was sharply reduced when observed at 15-second intervals one minute after being left at room temperature. It showed that the surface temperature was cooled to a temperature of 27.5 degrees after 60 seconds passed.

Alternately, as for the embodiment corresponding to the cosmetic vessel 1 including the impregnated sponge as the discharge unit 20, it showed that the surface temperature was sufficiently reduced. The surface was cooled to a temperature of 31.1 degrees after 60 seconds passed.

However, when the conventional cosmetic vessel was kept to reach 50 degrees and then exposed to room temperature, since the conventional cosmetic vessel did not include any configuration to sharply reduce the temperature, the conventional cosmetic vessel including the airless pump was maintained at the temperature of 35 degrees or higher after 60 seconds, and the conventional cosmetic vessel including the impregnated sponge was maintained at the temperature of approximately 40 degrees after 60 seconds.

In other words, based on the above-shown experimental data, when the cosmetic vessel 1 was heated to the temperature of 50 degrees and exposed at room temperature of 20 degrees, the metallic discharge plate 50 caused a sharp temperature reduction, so that a cooling effect was provided to the cosmetics discharged to the top surface of the discharge plate 50. Therefore, the cooling effect produced by the cosmetic vessel 1 was clearly shown based on the measured temperatures, which makes the cosmetic vessel 1 according to the present invention distinguished from the conventional cosmetic vessel. As a result, according to the present invention, user satisfaction may be significantly improved.

However, the temperature was more reduced when the cosmetic vessel 1 includes the airless pump 20 as the discharge unit 20 than when the cosmetic vessel 1 includes the impregnated sponge as the discharge unit 20. Such difference was made since there was little or no contact area between the airless pump 20 and the discharge plate 50 and the heat absorbed into the cosmetics when the cosmetic vessel 1 was kept at the temperature of 50 degrees was not transferred to the discharge plate 50.

As described above, since the discharge plate 50 of the cosmetic vessel 1 according to the present invention includes a metallic material, a sharp temperature reduction occurs at the top surface of the discharge plate 50, so that the heat in the cosmetics may be dissipated to the outside when the cosmetics are discharged to thereby maximize user satisfaction against a cooling effect.

Hereinafter, the antimicrobial effect of the cosmetic vessel 1 according to the present invention will be proved and described using the specific experimental data.

Figure 16:
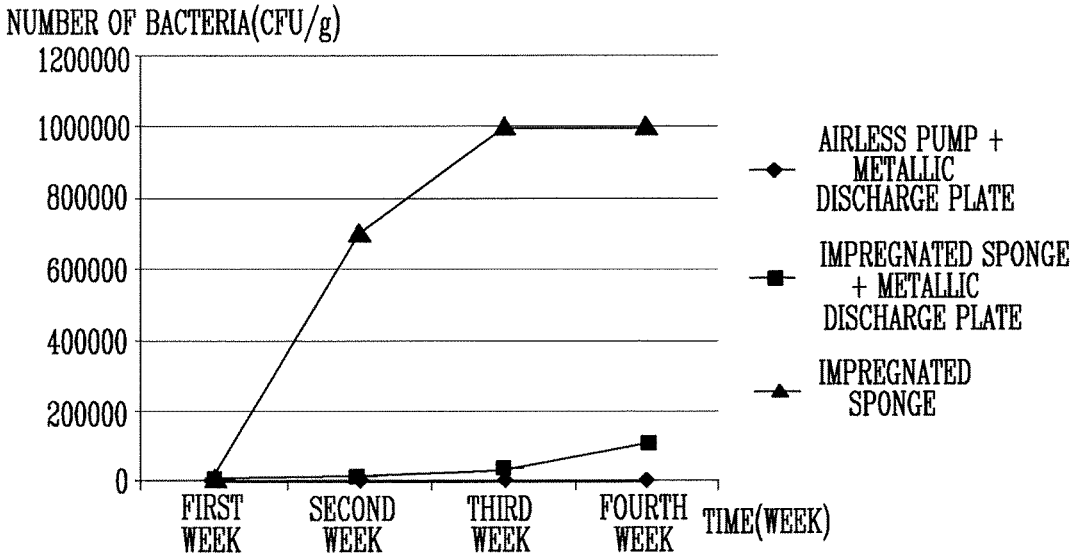
FIG. 16 is a graph illustrating propagation of bacteria in a cosmetic vessel according to the present invention.
Figure 17:
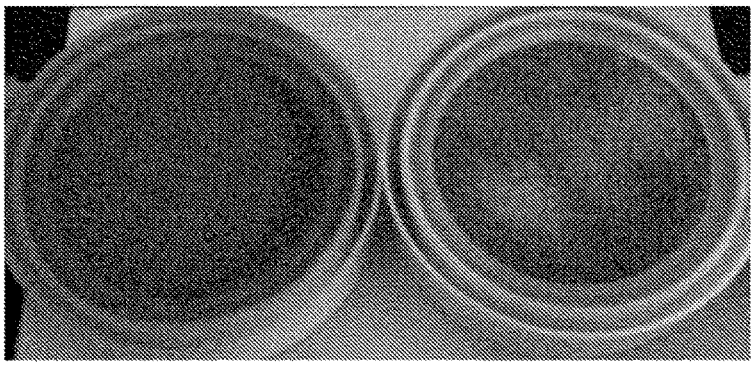
FIG. 17 is a view showing contamination of a conventional impregnated sponge.

FIG. 16 is a graph illustrating propagation of bacteria of a cosmetic vessel according to the present invention. FIG. 17 is a view illustrating contamination of a conventional impregnated sponge. Table 3 shows values of propagation velocity of a cosmetic vessel according to the present invention and a conventional cosmetic vessel. FIG. 16 is a graph of the values shown in Table 3.

In the experiments in FIG. 16 and Table 3, cosmetics with no preservatives were used. The experiments were performed on the cosmetic vessel 1 including the airless pump 20 as the discharge unit 20 and the cosmetic vessel 1 including the impregnated sponge as the discharge unit 20. The conventional cosmetic vessel including the impregnated sponge was used as a comparison group. In addition, the user applied the cosmetics of the cosmetic vessel with a puff for four weeks.

In addition, in the experiments in FIG. 17, the user applied a sunscreen (containing disodium phenylbenzimidazole sulfonic acid which is fluorescent under a UV lamp) and used the cosmetics on the impregnated sponge for a week or two according to the general directions. Whether or not the sunscreen remained on the impregnated sponge was checked using a UV lamp.

TABLE 3

| Configuration | $1^{st}$ week | $2^{nd}$ week | $3^{rd}$ week | $4^{th}$ week |
|---|---|---|---|---|
| Airless pump + metallic discharge plate | 20 | 20 | 20 | 20 |
| Impregnated sponge + metallic discharge plate | 20 | 10,000 | 30,000 | 100,000 |
| Impregnated sponge | 10,000 | 700,000 | 1,000,000 | 1,000,000 |

Since the cosmetic vessel 1 according to the present invention includes the metallic discharge plate 50, although the user applies the cosmetics discharged to the discharge plate 50 with the puff, dead skin cells or the like on the puff may not be introduced into the discharge unit 20, except through the discharge holes 51 of the discharge plate 50. Therefore, as shown in Table 3 and FIG. 16, the cosmetic vessel 1 showed little or no bacterial propagation in comparison with the conventional cosmetic vessel which did not include the discharge plate 50.

Since the discharge holes 51 of the discharge plate 50 of the cosmetic vessel 1 according to the present invention have a sufficiently small diameter (of 1 mm or less), even when the discharge unit 20 structurally communicates with the outside through the discharge holes 51, it may be very difficult to provide nutrients, such as dead skin cells, to bacteria. In addition, when the cosmetic vessel 1 includes the airless pump 20, the discharge holes 51 may not coincide with the outlet of the airless pump 20, so that supply of the nutrients may be completely blocked. Therefore, when the cosmetic vessel 1 used the airless pump 20, it showed that no bacterial propagation was observed.

On the other hand, as for the conventional cosmetic vessel using the impregnated sponge, the entire top surface of the impregnated sponge is exposed to the outside, and the puff directly contacts the impregnated sponge. Therefore, dead skin cells or the like on the puff continue to be provided to bacteria of the impregnated sponge. In other words, since the cosmetics were discharged from the impregnated sponge by the puff, rapid bacteria growth was observed.

With reference to FIG. 17, as the user kept applying the cosmetics on the impregnated sponge with the puff, it clearly showed that the sunscreen on the user's skin was transferred to the impregnated sponge. Thus, user's dead skin cells were also transferred to the impregnated sponge, which promoted continuous bacterial growth in the conventional cosmetic vessel.

On the other hand, according to the present invention, the discharge plate 50 of the cosmetic vessel 1 may effectively prevent the puff from directly contacting the discharge unit 20. When the cosmetic vessel 1 uses the airless pump 20, even if the user keeps applying the cosmetics with the puff, introduction of dead skin cells into the cosmetics received in the airless pump 20 is structurally impossible.

As described above, since the cosmetic vessel 1 includes the discharge plate 50 having the discharge holes 51 with a small diameter, the puff does not directly contact the outlet of the discharge unit 20. Thus, when the user applies makeup using the puff, supply of nutrients through the puff to bacteria remaining in the cosmetics may be prevented to thereby completely block contamination of the cosmetics.

Table 4 below shows the number of surviving bacteria in the cosmetic vessel 1. The experiments were performed by inoculating the cosmetics in the discharge unit 20 of the cosmetic vessel 1 according to the present invention with bacteriomycota (colon *bacillus*, pyogenic *bacillus*, and *pseudomonas aeruginosa*) or eumycetes (*aspergillus niger* and *candida albicans*) and determining the number of living cells on a daily basis.

The number of bacteria was obtained by taking a 1 gram sample of the cosmetics, diluting the sample with a neutralization liquid ten times, smearing it on an SDC medium, culturing it in an incubator at 37 degrees for 24 hours or more, and observing the number of colonies (the number of bacteria). The fungus number was obtained by taking a 1 gram sample of the cosmetics, diluting the sample with a neutralization liquid ten times, smearing it on an SDA medium, culturing it in an incubator at 30 degrees for 24 hours or more, and observing the number of colonies (the fungus number)

TABLE 4

| Discharge unit | Initial | 1st day | 2nd day | 3rd day | 4th day |
|---|---|---|---|---|---|
| | | Bacteriomycot (CFU/g) | | | |
| Airless pump | 8.0 * 10^6 | 1200 | less than 20 | less than 20 | less than 20 |
| Impregnated sponge | | 400000 | 20000 | 8000 | 400 |
| | | Eumycetes (CFU/g) | | | |
| Airless pump | 6.0 * 10^5 | 200 | less than 20 | less than 20 | less than 20 |
| Impregnated sponge | | 30000 | 8000 | 720 | 160 |

The cosmetic vessel 1 according to the present invention may include the airless pump 20 or the impregnated sponge as the discharge unit 20. However, the airless pump 20 prevents air inlet, whereas the impregnated sponge may allow inlet of a certain amount of air.

Referring to Table 4, when the discharge unit 20 of the cosmetic vessel 1 was the airless pump 20, the number for each of the bacteriomycot and eumycetes was sharply reduced to less than 20 on the second day. Nutrients that bacteria need for survival were not supplied since the airless pump 20 prevents air inlet to the cosmetics received therein.

On the other hand, when the discharge unit 20 of the cosmetic vessel 1 was the impregnated sponge, the number of living cells for each of bacteriomycot and eumycetes was greater than that obtained when the airless pump 20 was used.

In other words, according to the above experimental results, since the cosmetic vessel 1 uses the airless pump 20 instead of the impregnated sponge as the discharge unit 20, the number of surviving bacteria may be minimized to significantly prevent contamination of the cosmetics.

Hereinafter, durability and hygiene of the cosmetic vessel 1 are described using the specific experimental data.

Figure 18:
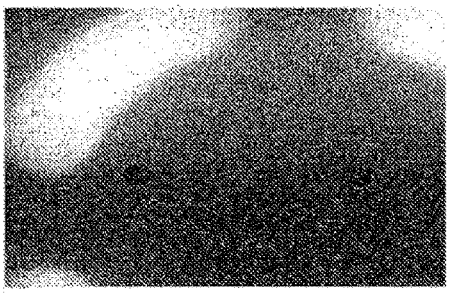
FIG. 18 is a view showing wear depending on the material of a discharge plate of a cosmetic vessel according to the present invention.
Figure 18:
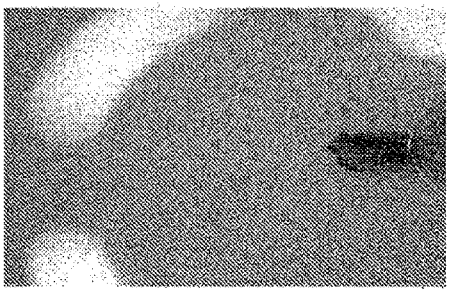
Figure 18:
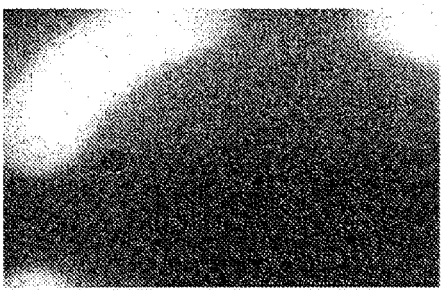
Figure 18:
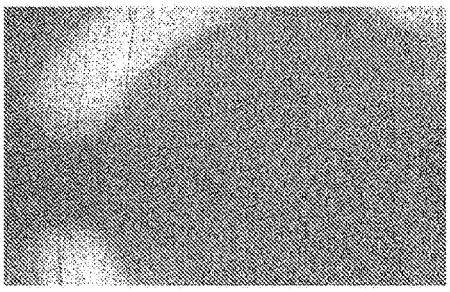

FIG. 18 is a view showing wear depending on a material of a discharge plate of a cosmetic vessel according to the present invention.

In the experiments in FIG. 18, the discharge plate 50 of the cosmetic vessel 1 included an SUS 304 stainless steel, and the discharge plate 50 including general plastics was used as a control group.

As shown in FIG. 18, when the top surface of the discharge plate 50 from which the cosmetics are discharged was rubbed twenty times by the puff, the metallic discharge plate 50 was not scratched at all. However, it clearly showed that the plastic discharge plate 50 was badly scratched after being used only twenty times.

In other words, since the discharge plate 50 of the cosmetic vessel 1 according to the present invention includes a metal instead of plastics, the discharge plate 50 may be prevented from wearing down when the cosmetics on the top surface of the discharge plate 50 is rubbed with the puff. In addition, since the present invention suppresses the generation of scratches, the cosmetic vessel 1 may ensure durability and hygiene in comparison with the conventional cosmetic vessel which spoils the beauty of the cosmetic vessel and accelerates contamination.

The cosmetics used in the cosmetic vessel 1 may contain an inorganic pigment having solid particles such as calcium carbonate (CaCO3), titanium oxide (TiO2), talc, a natural mineral, or a metal compound. Since the cosmetics include the inorganic pigment having a high hardness, when the cosmetics are spread over the top surface of the discharge plate 50 by the puff, the discharge plate 50 may wear down. Therefore, the discharge plate 50 of the cosmetic vessel 1 may have a Vickers hardness ranging from 120 HV to 200 HV. Here, Vickers hardness refers to a value obtained by performing an ASTM E92 Vickers hardness test. Diamond is pressed into a test sample, and an area corresponding to the resulting indentation was quantified to obtain a Vickers hardness value.

Therefore, in the present invention, since the discharge plate 50 has a Vickers hardness of 120 HV or more, even when the cosmetics containing the inorganic pigment having a high hardness, the discharge plate 50 may be prevented from being scratched or wearing down when friction is caused by the puff. In addition, in the present invention, since the discharge plate 50 has a Vickers hardness of 200 HV or less, manufacturing costs of the discharge plate 50 may be optimized, and processing and forming (an etching process performed to form the discharge holes 51) may be facilitated.

In addition, according to the present invention, since the top surface of the discharge plate 50 is exposed to the outside and the user applies the cosmetics discharged to the top surface of the discharge plate 50 with the puff, the surface of the discharge plate 50 onto which the user presses the puff to pick up the cosmetics is separated from the discharge unit 20, so that the surface onto which the puff is pressed may be cleaned at any time to keep the discharge plate 50 clean.

As shown in Table 5 below, fifty users evaluated hygiene and gave grades on a scale of zero to five with respect to the cosmetic vessel 1 including the airless pump 20 or the impregnated sponge as the discharge unit 20 and the conventional cosmetic vessel including either the airless pump or the impregnated sponge. In terms of hygienic aspect, the cosmetic vessel 1 received higher grades than the conventional cosmetic vessel. More specifically, when compared with the conventional cosmetic vessel including only the impregnated sponge, the cosmetic vessel 1 including the discharge plate 50 according to the present invention may improve hygiene.

TABLE 5

| | Airless pump + metallic discharge plate | Impregnated sponge + metallic discharge plate | Airless pump | Impregnated sponge |
|---|---|---|---|---|
| Usage satisfaction (hygiene) | 5 | 4.5 | 4 | 1 |

Therefore, since the cosmetics discharged from the discharge unit 20 are discharged to the top surface of the discharge plate 50, and the remaining cosmetics on the top surface of the discharge plate 50 exposed to the outside may be cleaned, hygiene may be improved in comparison with the conventional cosmetic vessel. As a result, the user may avoid skin problems.

As described above, the present invention has an excellent cooling effect according to the user satisfaction with cooling and the experimental data on surface temperature changes, ensures antimicrobial properties according to the experimental data on the number of surviving bacteria and the propagation number of bacteria, and secures durability and hygiene according to the experimental data on the generation of scratches and user satisfaction with hygiene. Therefore, the present invention may maximize user satisfaction.

From the foregoing, it will be appreciated that various embodiments of the present invention have been described herein for purposes of illustration. It will be apparent to those skilled in the art that various modifications can be made to the above-described exemplary embodiments of the present invention without departing from the spirit or scope of the invention.

Accordingly, the various embodiments disclosed herein are not intended to be limiting, with the true scope and spirit being indicated by the following claims.

The invention claimed is:

1. A cosmetic vessel, comprising:

an airless pump discharging cosmetics to an outside;

a discharge plate provided at one side of the airless pump from which the cosmetics are discharged, including a plurality of discharge holes, formed of a metal, contacted with a user's puff and exposed to the outside;

a guide plate provided between the airless pump and the discharge plate and guiding the cosmetics from the airless pump to the plurality of discharge holes; and a rim portion fixing the guide plate and the discharge plate, wherein the rim portion moves downwards while fixing the guide plate and the discharge plate, wherein the rim portion surrounds an edge of the discharge plate to fix the discharge plate and the guide plate, and wherein the cosmetics are discharged from the airless pump by pressurizing the discharge plate.

2. The cosmetic vessel of claim 1, wherein the cosmetics are discharged from the airless pump by pressurizing the rim portion surrounding the edge of the discharge plate.

3. The cosmetic vessel of claim 1, wherein the rim portion is formed integrally with the discharge plate.

4. The cosmetic vessel of claim 1, wherein the guide plate moves downwards with the rim portion when the discharge plate is pressed to cause the discharging unit to discharge the cosmetics.

5. The cosmetic vessel of claim 1, wherein the discharge holes are formed by etching.

6. The cosmetic vessel of claim 1, wherein the diameter of discharge holes range from 0.1 mm to 1 mm.

* * * * *